US006266924B1

(12) United States Patent
Rissone

(10) Patent No.: US 6,266,924 B1
(45) Date of Patent: Jul. 31, 2001

(54) METHOD AND SYSTEM FOR SEALING AROUND DOOR

(76) Inventor: Robert Rissone, 134 Norcrest Dr., Rochester, NY (US) 14617

( * ) Notice: Subject to any disclaimer, the term of this patent is extended or adjusted under 35 U.S.C. 154(b) by 0 days.

(21) Appl. No.: 09/594,578

(22) Filed: Jun. 15, 2000

Related U.S. Application Data

(62) Division of application No. 09/045,800, filed on Mar. 23, 1998, which is a division of application No. 08/616,636, filed on Mar. 15, 1996, now Pat. No. 6,058,654, which is a continuation of application No. 08/258,528, filed on Jun. 10, 1994, now Pat. No. 5,577,349.

(51) Int. Cl.[7] ..... E06B 7/20
(52) U.S. Cl. ..... 49/308; 49/306
(58) Field of Search ..... 49/303, 305, 306, 49/307, 308, 309, 310, 311, 312, 313, 314; 232/17, 19, 22, 49, 48

(56) References Cited

U.S. PATENT DOCUMENTS

| | | | | |
|---|---|---|---|---|
| 719,657 | | 2/1903 | Grover . | |
| 736,392 | | 8/1903 | Henry . | |
| 770,330 | * | 9/1904 | Steger | 49/314 |
| 872,976 | | 12/1907 | Smith . | |
| 888,131 | | 5/1908 | Wade . | |
| 1,602,837 | * | 10/1926 | Rhodes | 232/17 |
| 1,912,561 | | 6/1933 | Williams . | |
| 2,188,815 | | 1/1940 | Murphy . | |
| 2,225,819 | * | 12/1940 | Brunker | 49/314 X |
| 3,327,429 | | 6/1967 | Slaughter . | |
| 3,448,543 | | 6/1969 | Multer . | |
| 3,642,164 | | 2/1972 | O'Neal et al. . | |
| 3,704,547 | | 12/1972 | Hansen et al. . | |
| 4,333,603 | * | 6/1982 | Carlson | 232/17 |
| 4,528,775 | | 7/1985 | Einaesson . | |
| 4,614,060 | | 9/1986 | Dymenil et al. . | |
| 4,742,646 | | 5/1988 | Kehrli . | |
| 5,000,378 | * | 3/1991 | Dorr et al. | 232/17 |
| 5,577,349 | | 11/1996 | Rissone . | |
| 6,058,654 | * | 5/2000 | Rissone | 49/314 |

FOREIGN PATENT DOCUMENTS

| | | |
|---|---|---|
| 225115 | 8/1957 | (AU) . |
| 258422 | 3/1965 | (AU) . |
| 573864 | 4/1959 | (CA) . |

* cited by examiner

*Primary Examiner*—Jerry Redman
(74) *Attorney, Agent, or Firm*—Nixon & Vanderhye P.C.

(57) ABSTRACT

A multi-finger door frame seal which results in reduced hinge bind and which creates a predetermined sound upon opening of the door is disclosed. The frame seal is mounted on the stop on the hinge jamb, while on the rabbett on the lock jamb thereby reducing hinge bind during closing of the door. Use of the multi-finger frame seal according to certain embodiments results in a generation of a predetermined sound upon opening of the door. Also disclosed is a security seal system for use adjacent the bottom of the door. The security seal includes a flap which may be either gravity-actuated or spring-actuated. In spring-actuated embodiments, a cam forces the security flap downward into the closed position as the door is closed. While in gravity-actuated embodiments, closing of the door results in gravity causing the security flap to move downward into the closed position where it is maintained while the door is closed.

3 Claims, 25 Drawing Sheets

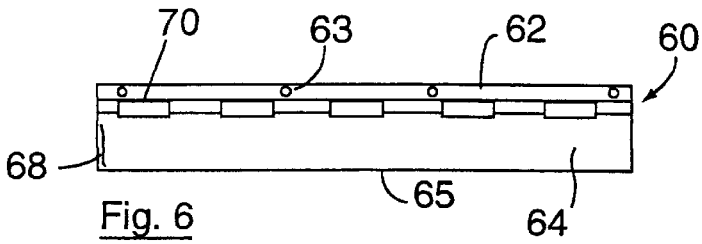
Fig. 6
Fig. 7
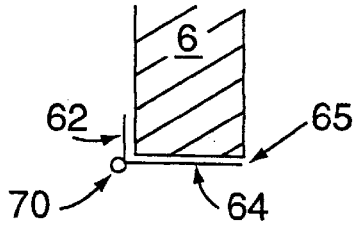
Fig. 8
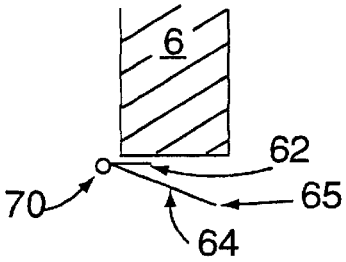
Fig. 9
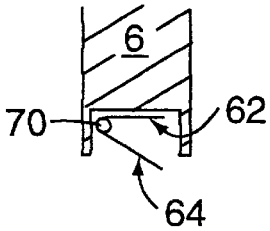
Fig. 10
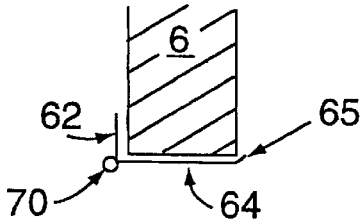
Fig. 11
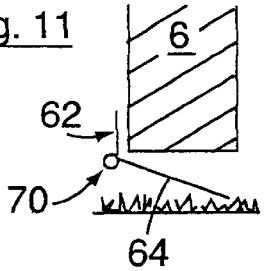
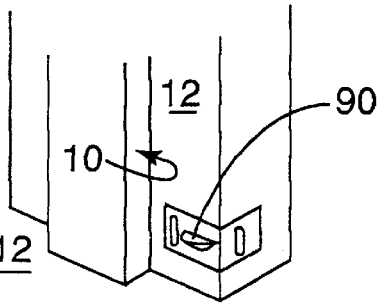
Fig. 12
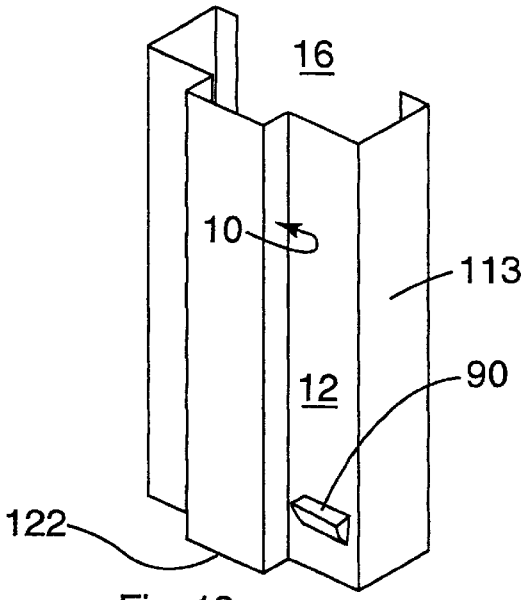
Fig. 13

6
130
131
131
131
132
135
136
140
138
138
113
70
139
134
139
137

139
143
139
142

138
137
139
142

METHOD AND SYSTEM FOR SEALING AROUND DOOR

This Application is a Divisional of Ser. No. 09/045,800 filed Mar. 23, 1998, which is a Divisional of Ser. No. 08/616,636 filed Mar. 15, 1996 U.S. Pat. No. 6058,654, which is a C-I-P of Ser. No. 08/258,528 filed Jun. 10, 1994, U.S. Pat. No. 5,577,349.

This invention is related to a door sealing system. More particularly, this invention is related to a method and system for providing a multi-finger door frame seal and a door security seal to be disposed adjacent the bottom of a door.

BACKGROUND OF THE INVENTION

U.S. Pat. No. 4,742,646 to Kehrli discloses a multi-frame weather seal adapted to be affixed to a door frame surrounding a door. The frame seal of the '646 patent has its base affixed upon the rabbett on both sides of the door, namely, the hinge side and the lock side. This arrangement results in hinge bind problems which make it difficult to close a door adjacent which the Kehrli multi-finger seal is affixed. Accordingly, there exists a need in the art for an improvement which substantially eliminates the hinge bind problems associated with the Kehrli multi-finger seal.

A current problem in the marketplace exists in that hotel rooms, dormitories, and the like may be broken into by burglars accessing the door's locking mechanism by way of going "under the door". Accordingly, there exists a need in the art for a security seal to be positioned underneath doors which would reduce the likelihood of burglars being able to break into these type rooms.

U.S. Pat. No. 4,528,775 discloses a seal affixed to the bottom or underside of a door for the purpose of shutting off draft, dampening noise, and sealing dust and the like. The door bottom seal of the '775 patent is not a security seal, as evident by its design which includes a resilient lath affixed directly to the bottom of the door, the lath being actuated, for example, by a leaf spring. At a certain position during closing of the door, an end of the leaf spring projecting laterally outward from the door toward the jamb is forced inward thereby causing the middle portion of the spring to flex downward. Downward flexing of the leaf spring forces the head of the lath toward the floor in certain areas.

In view of the above, it is apparent that there exists a need in the art for both an improved security seal for affixation at or below a door and an improved multi-finger door frame seal for affixation in a door frame surrounding the door, the overall door sealing system for improving performance with respect to fire codes, heating/ventilating codes, and industry self-policing codes (e.g. ASTM, NFPA, and/or ANSI codes). Also, such smoke seals should function to prevent fire-fueling oxygen from entering such rooms.

SUMMARY OF THE INVENTION

Generally speaking, this invention satisfies the above-described needs in the art by providing a security seal system for attachment adjacent a bottom of a door within a door frame over a floor, the door having exterior and interior sides, the security seal system comprising:

- a door engaging member affixed to the door;
- a security flap pivotally connected to the door engaging member by way of a hinge;
- an actuator or cam affixed to one of the door frame and the floor; and
- the security flap including an actuator or cam engaging surface for contacting the actuator or cam when the door is being closed thereby causing the security flap to move downward away from the bottom of the door so as to form a security seal under the door when the door is in a closed position.

Still further, this invention satisfies the above-described needs in the art by providing a multi-finger cushioning frame seal for affixation to a door frame surrounding a door, the multi-finger frame seal comprising:

- a base member;
- first and second flexible fingers extending from the base member; and
- a flexible bridge spaced from the base and connected between the first and second fingers so as to define a space bounded by the fingers, the base, and the bridge.

IN THE DRAWINGS

FIG. 2(*a*) is a side elevational cross-sectional view of the multi-finger frame seal of FIGS. 1–2, except that a kerf engaging tab for affixing the seal on the hinge jamb is provided.

FIG. 2(*b*) is a side elevational cross-sectional view of the multi-finger frame seal of FIGS. 1–2, except that a kerf engaging tab for mounting on the lock jamb is also provided.

FIG. 3(*a*) is a side elevational cross-sectional view of the multi-finger frame seal of FIG. 3 except that a kerf engaging tab for mounting on the hinge jamb is also provided.

FIG. 3(*b*) is a side elevational cross-sectional view of the three finger seal of FIG. 3 except that a kerf engaging tab for affixing the seal on the lock jamb is also provided.

FIG. 6 is an elevational view of a spring-biased security seal for affixation to the bottom of a door.

FIG. 7 is a side elevational cross-sectional view illustrating the security seal of FIG. 6 affixed adjacent the bottom of a door.

FIG. 8 is a side elevational cross-sectional view illustrating the security seal of FIG. 6 attached to the bottom of a door so that its door engaging portion is attached to the underneath or bottom side as opposed to the embodiment shown in FIG. 7 where the door engaging portion is affixed to the interior face of the door.

FIG. 9 is a side elevational cross-sectional view illustrating the security seal of FIG. 6 affixed adjacent the bottom of a door in a recess defined therein, FIGS. 8 and 9 illustrating the seal when the door is in the closed position.

FIG. 10 is a side elevational cross-sectional view of the security seal of FIG. 6 including an angled distal end so as to achieve easy sliding of the security flap across rugs and the like.

FIG. 11 is a side elevational cross-sectional view of the security seal of FIGS. 6–7 contacting the floor when the door is in the closed position.

FIG. 12 is a perspective view illustrating an actuating cam and corresponding bracket affixed to the door frame for use in conjunction with a spring-biased security seal (e.g. FIG. 6).

FIG. 13 is a perspective view illustrating another type of security seal actuating cam affixed to the door frame.

Figure 25:
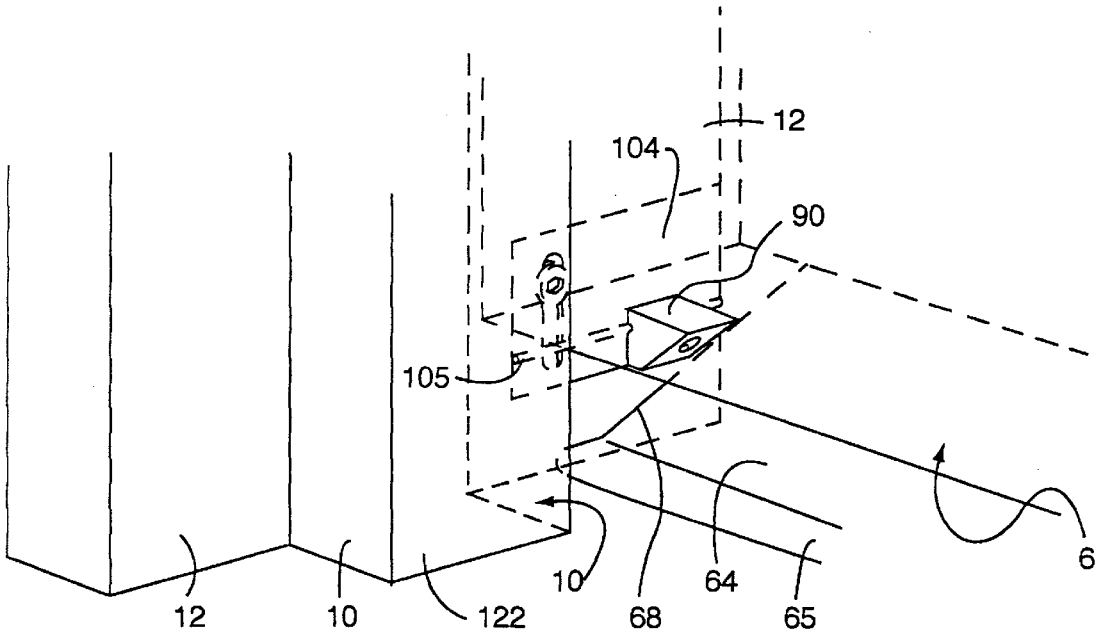
FIG. 25(*a*) is a perspective view illustrating the actuating cam of FIGS. 18–19 mounted to a door frame, with the cam contacting the security flap in the door closed position.
Figure 25:
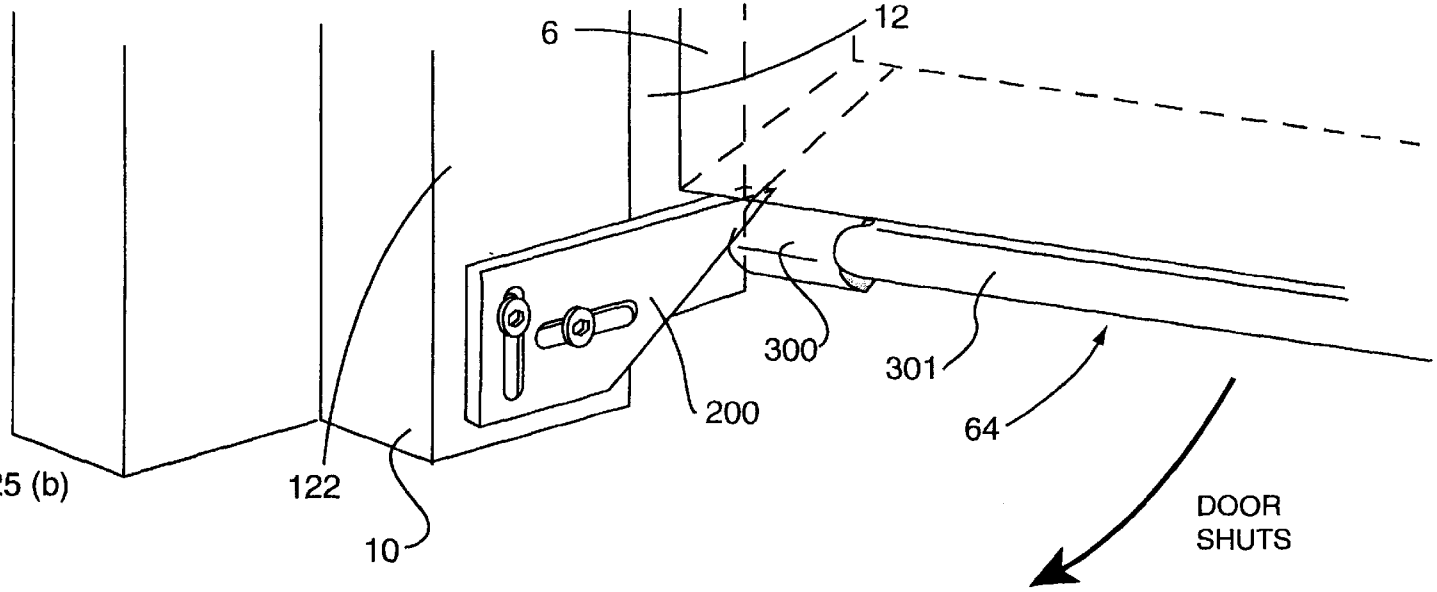
Figure 25:
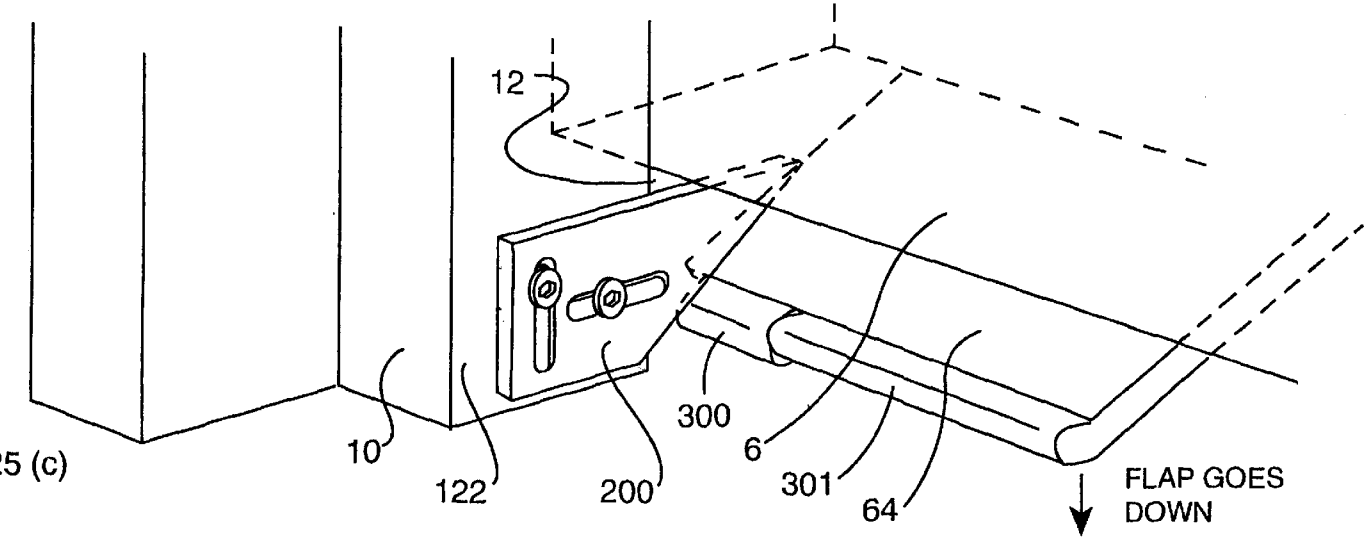

FIGS. 25(*b*)–25(*c*) are perspective views of a door closing with a security flap distal end according to another embodiment of this invention.

Figures 26, 27, 28:
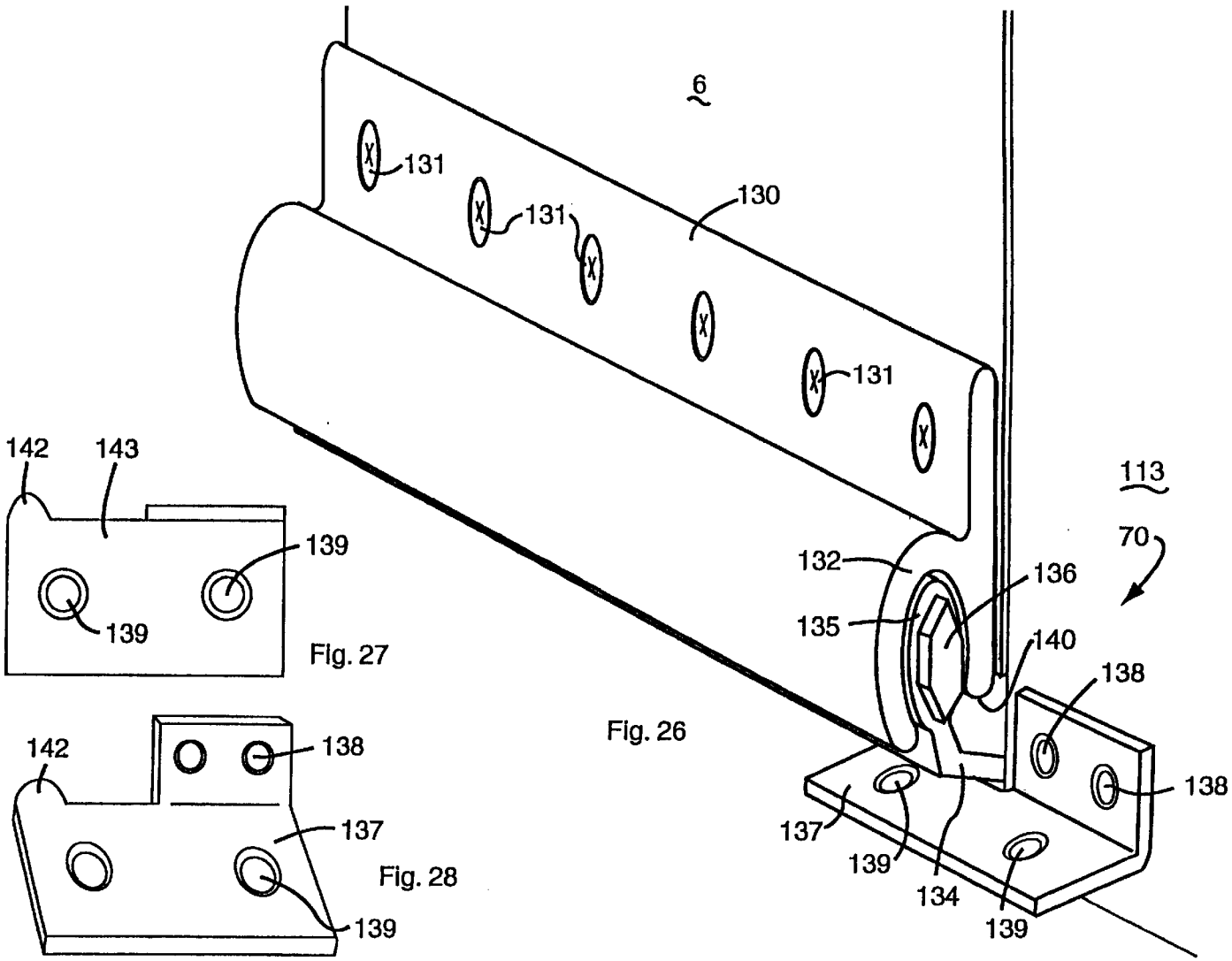

FIG. 26 is a perspective view illustrating a gravity-actuated door security seal attached to a door in the door closed position.

FIGS. 27–28 illustrate the actuating cam to be used in conjunction with the gravity-actuated security seal of FIG. 26.

Figure 29:
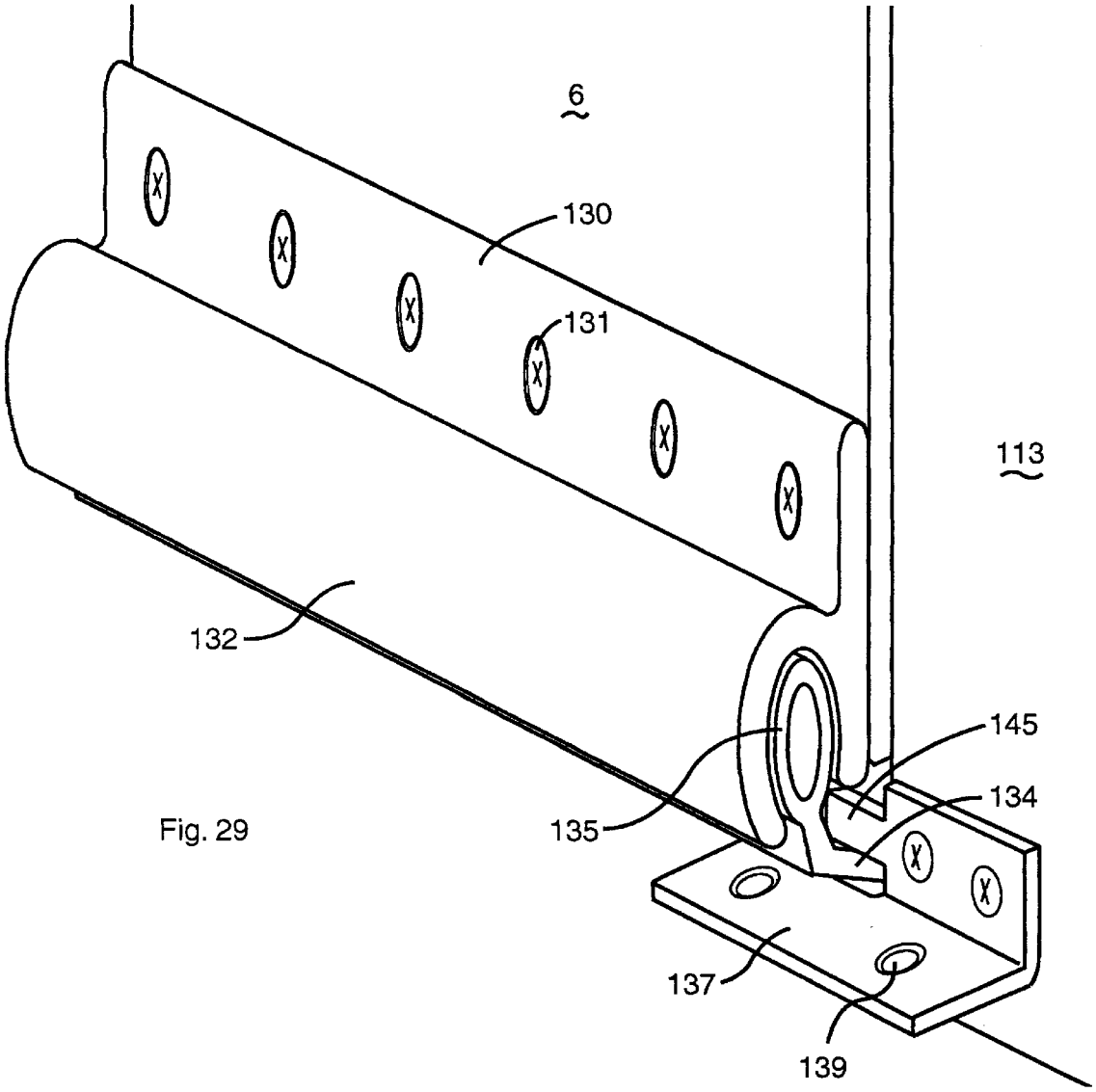

FIG. 29 is a perspective view illustrating another embodiment of a gravity-actuated door security seal, this embodiment differing from the FIG. 26 embodiment in that a flap locking device is integrally formed with the actuator in order to maintain the flap in the down position when the door is closed.

Figure 30:
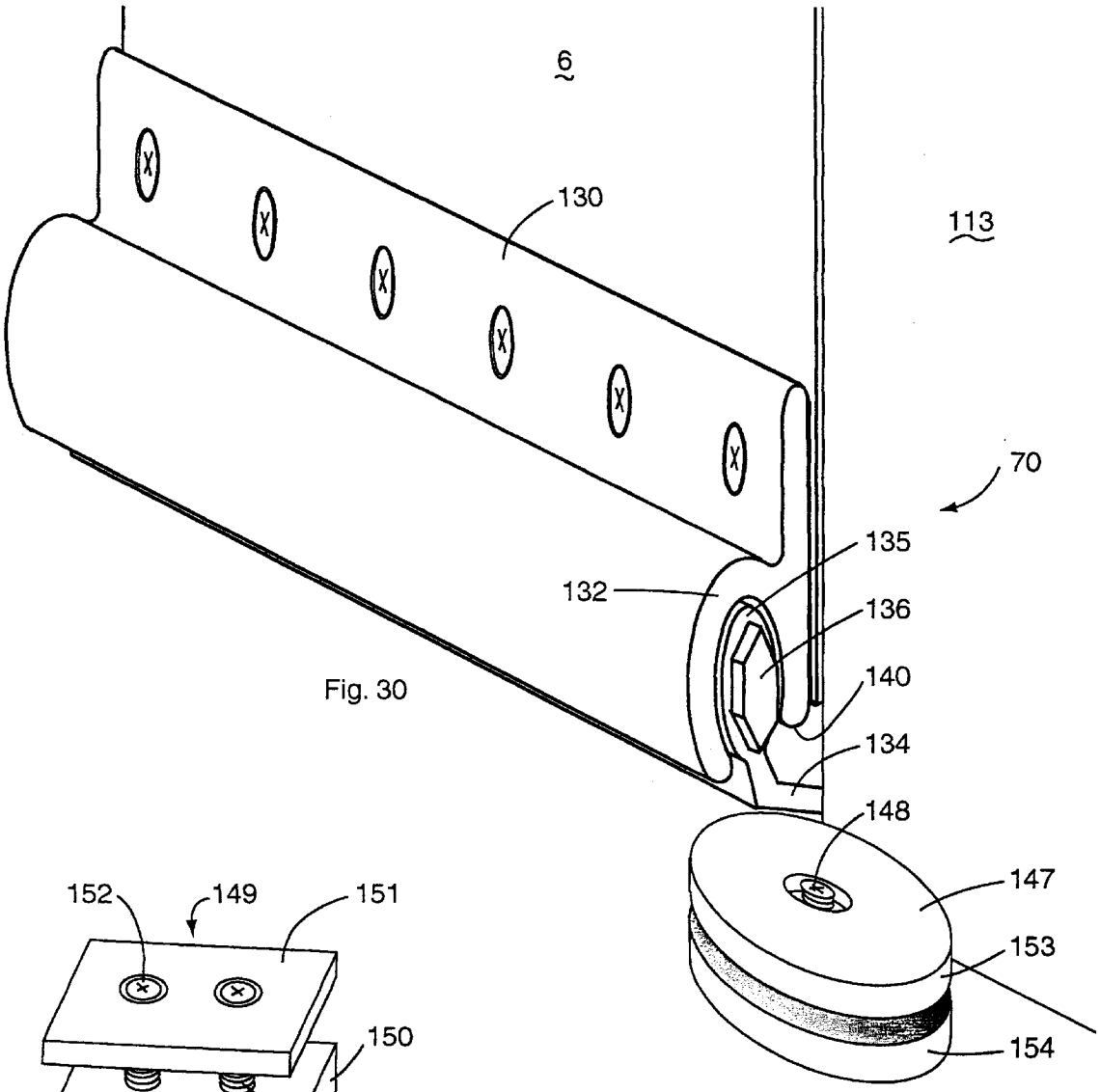

FIG. 30 is a perspective view of yet another gravity-actuated security seal according to this invention.

Figure 31:
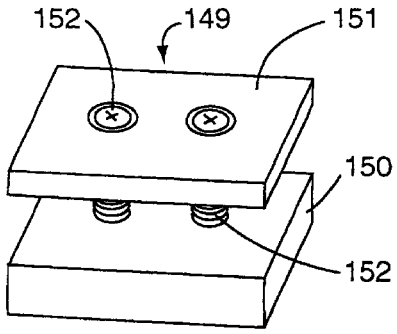

FIG. 31 is a perspective view of another actuator which may be used in conjunction with the gravity-actuated security seal of FIG. 30.

Figure 32:
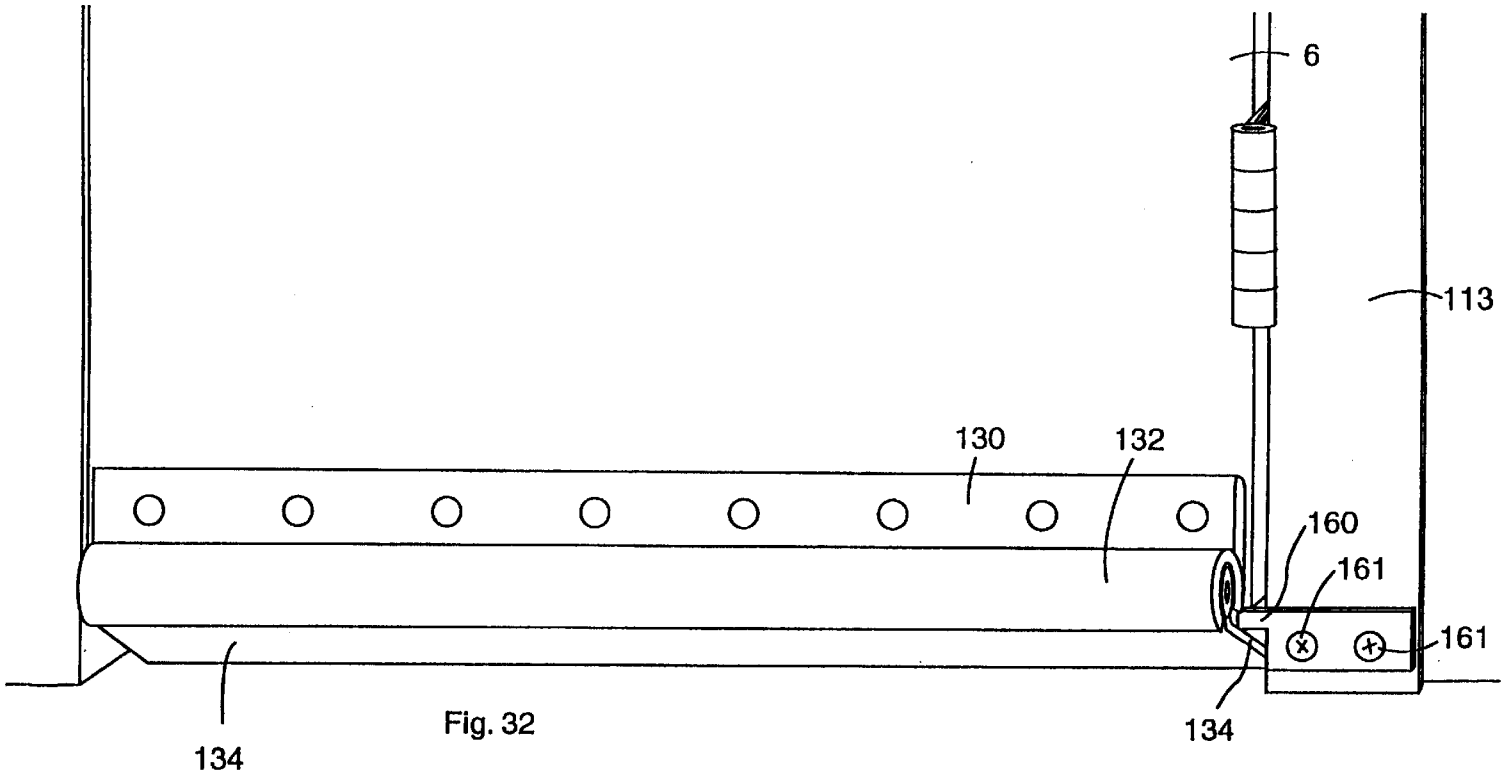

FIG. 32 is a perspective view illustrating a flap locking member mounted on the door frame which may be used in conjunction with any of the security seals discussed above.

Figure 33:
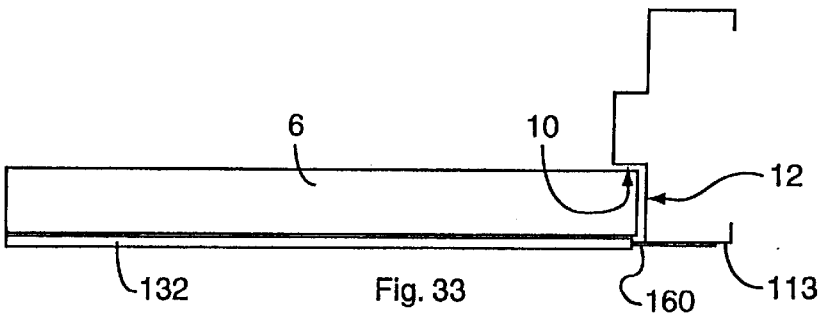

FIG. 33 is a top elevational view illustrating the door, frame, and flap locking member of FIG. 32.

Figure 34:
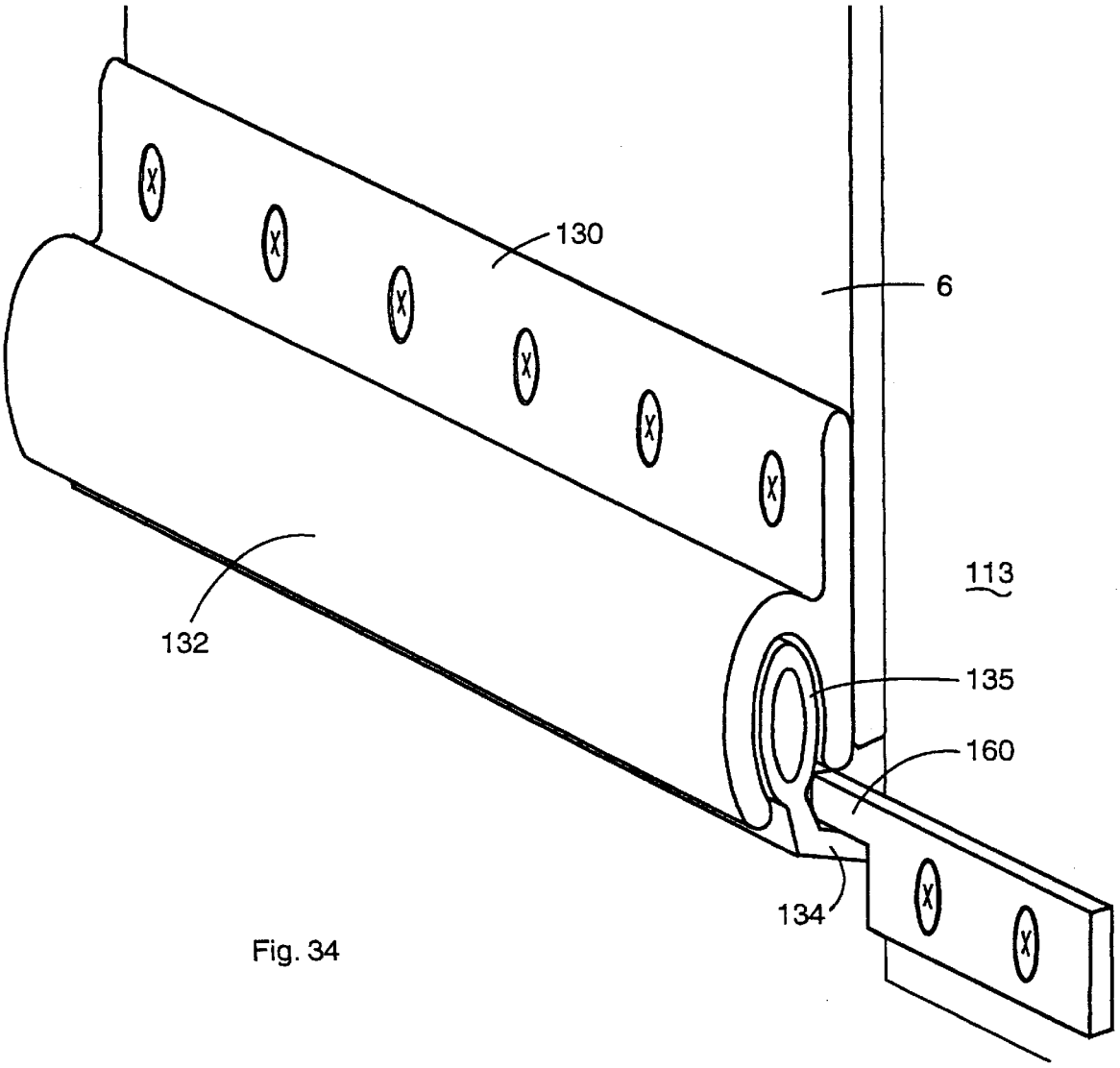

FIG. 34 is a perspective view illustrating the flap locking member of FIG. 32 mounted on door frame for use in conjunction with a different type of security flap design.

Figure 35:
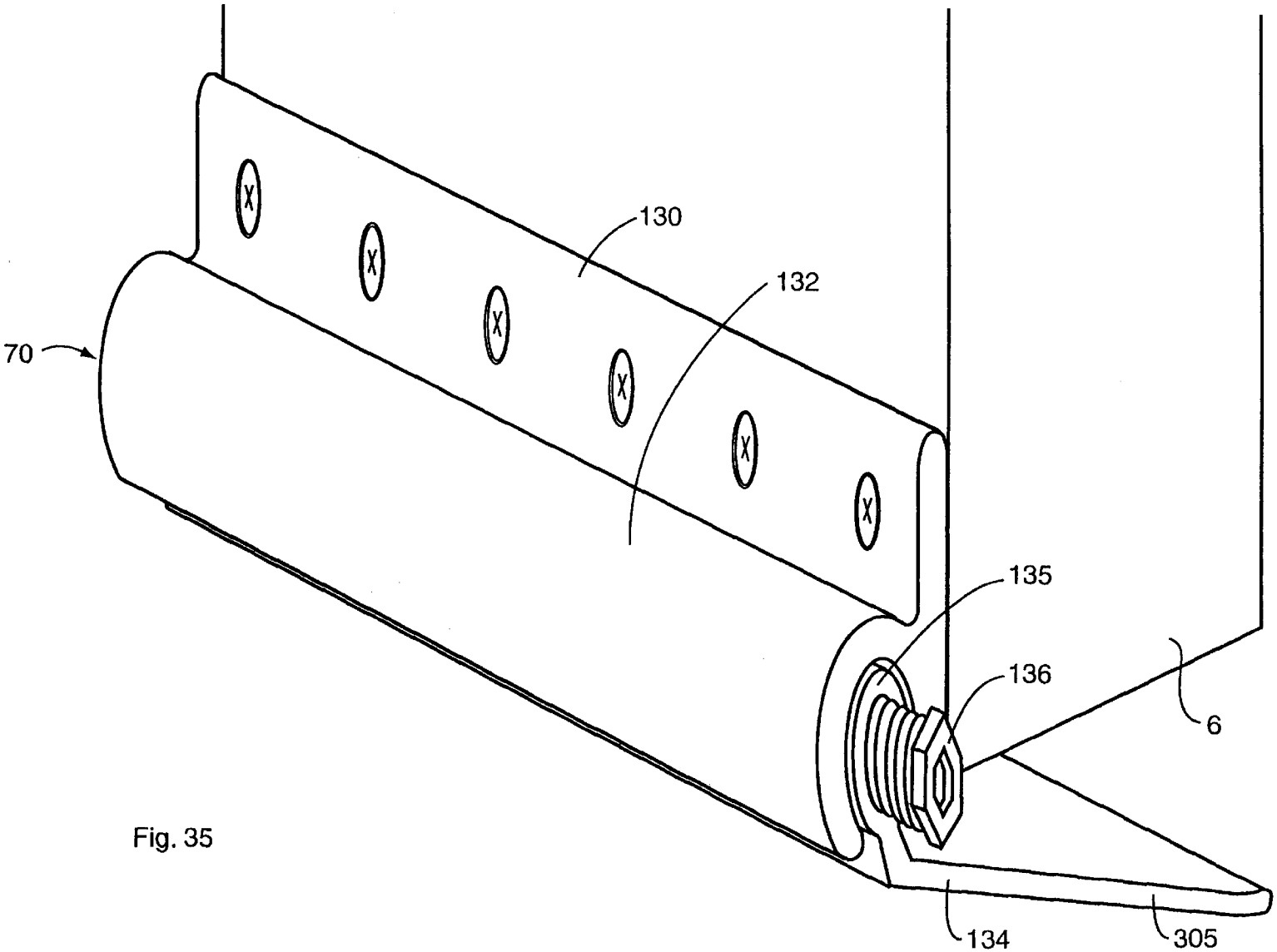

FIG. 35 is a perspective view illustrating how the flap core or rod may be held in position in the housing by threading a hex head screw into opposing ends.

Figure 36:
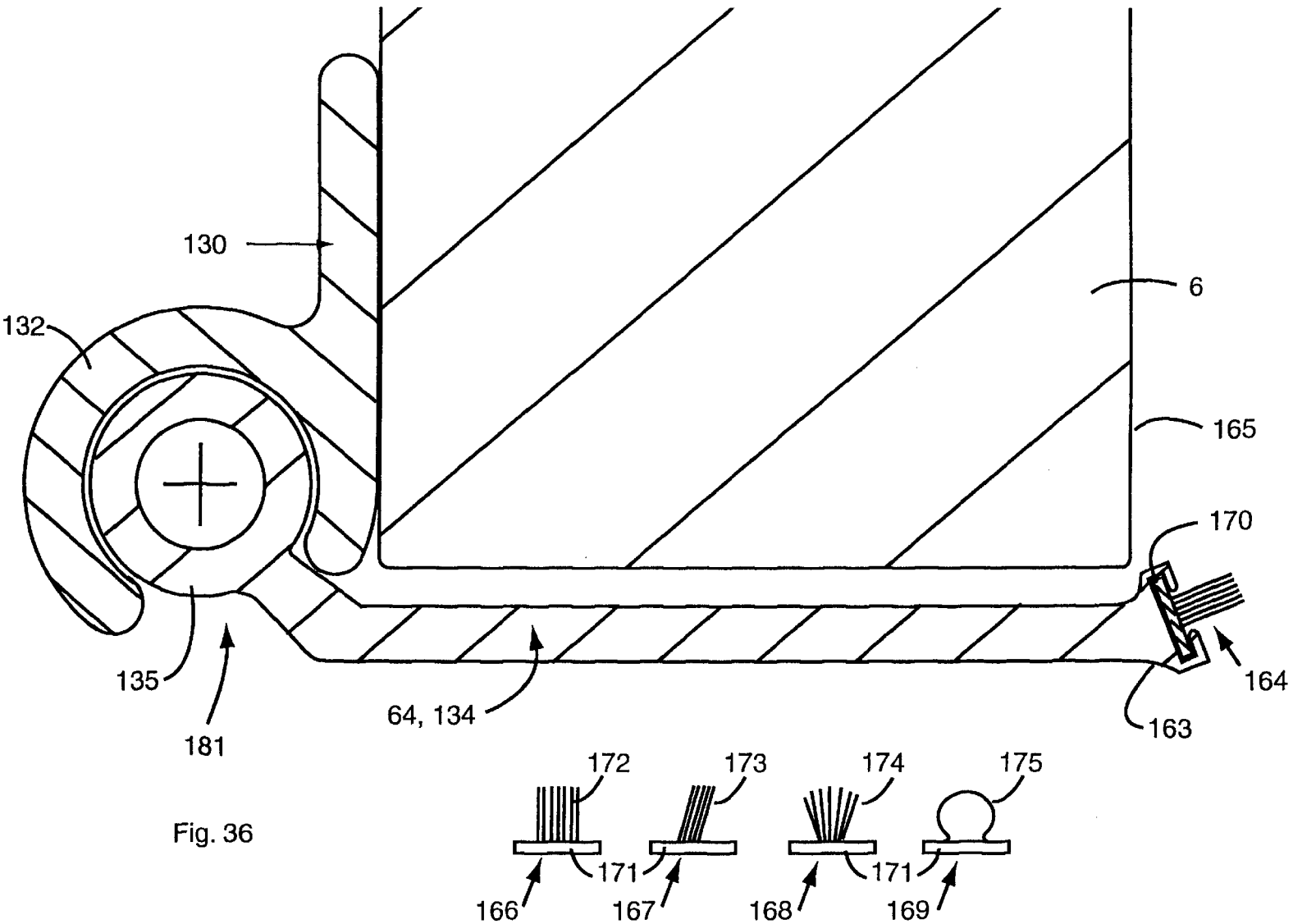

FIG. 36 is a side elevational cross-sectional view of a security seal according to any of the above embodiments wherein an insert element may be inserted into the distal end of the security flap via a keyway defined therein for the purpose of additional sealing.

Figure 37:
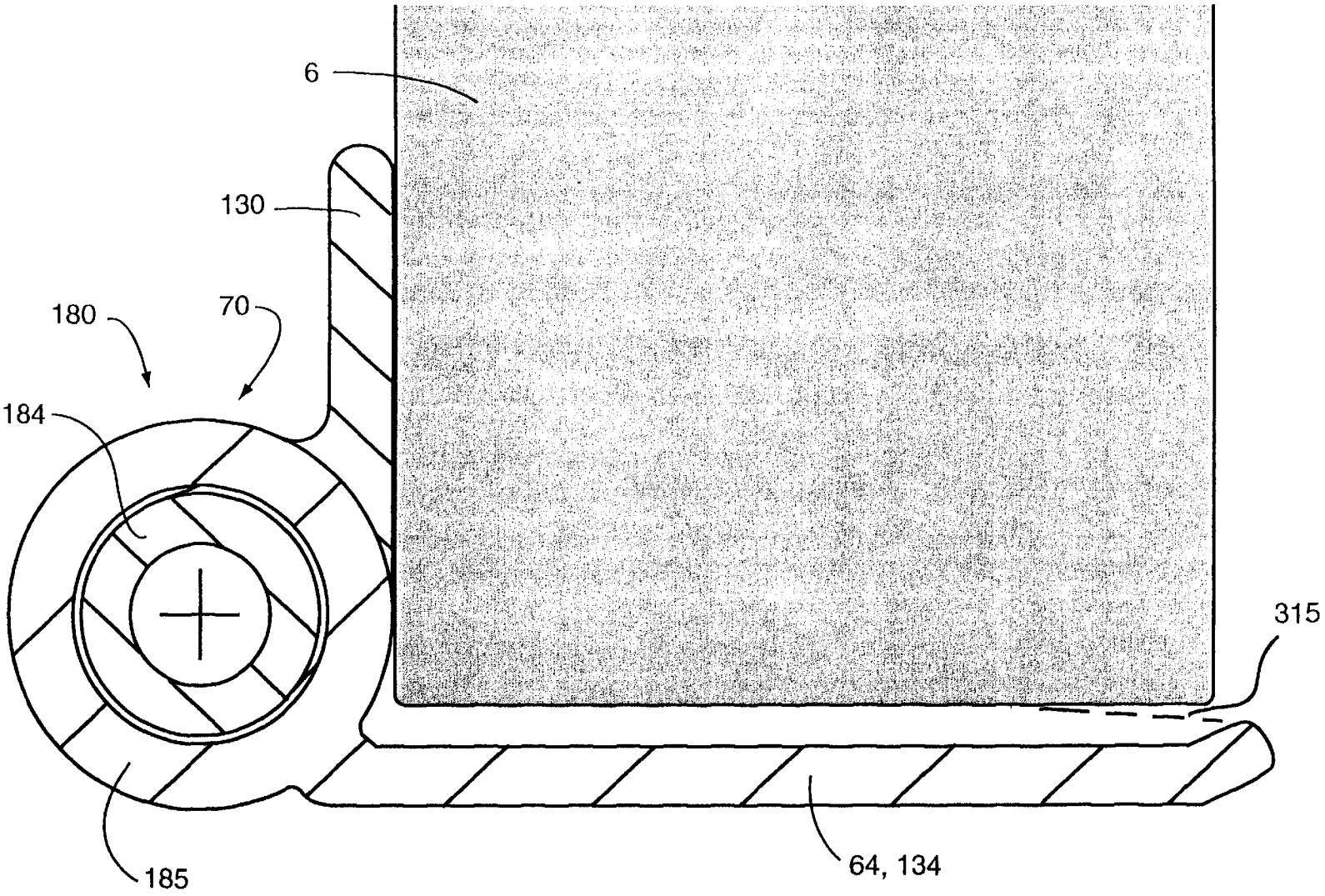

FIG. 37 is a side elevational cross-sectional view of a security seal having a hinge according to another embodiment of this invention.

Figure 38:
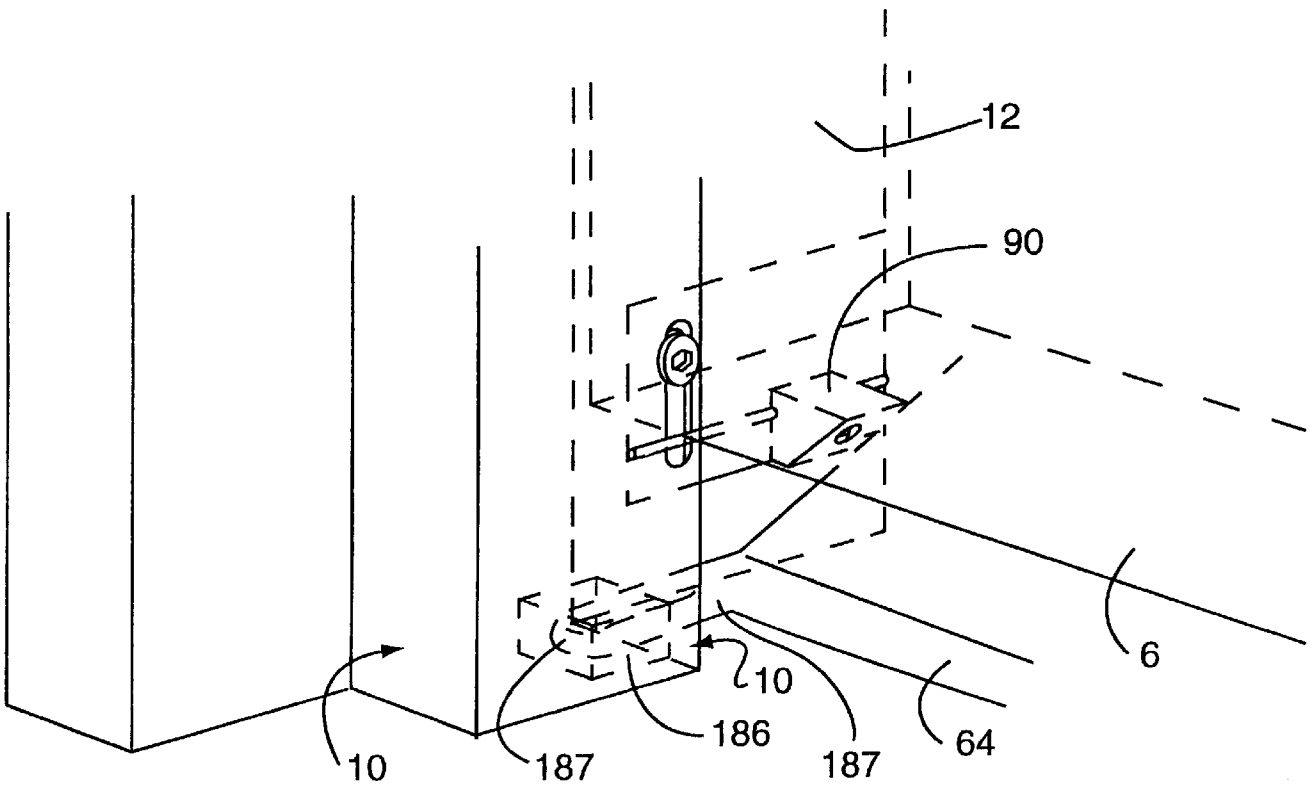

FIG. 38 is a perspective view illustrating a spring loaded security seal according to still another embodiment of this invention wherein a recess or cavity is provided in the stop with a projection from the flap extending therein for the purpose of maintaining the flap in the downward position when the door is closed.

Figure 39:
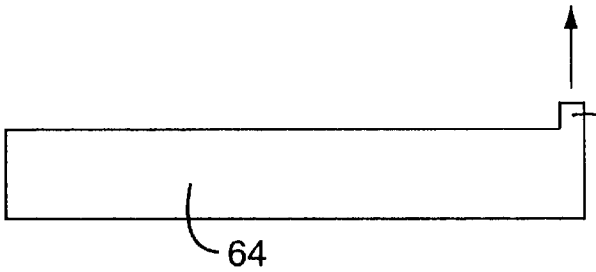

FIG. 39 is a top elevational view of the flap and its projection element of FIG. 38.

Figure 40:
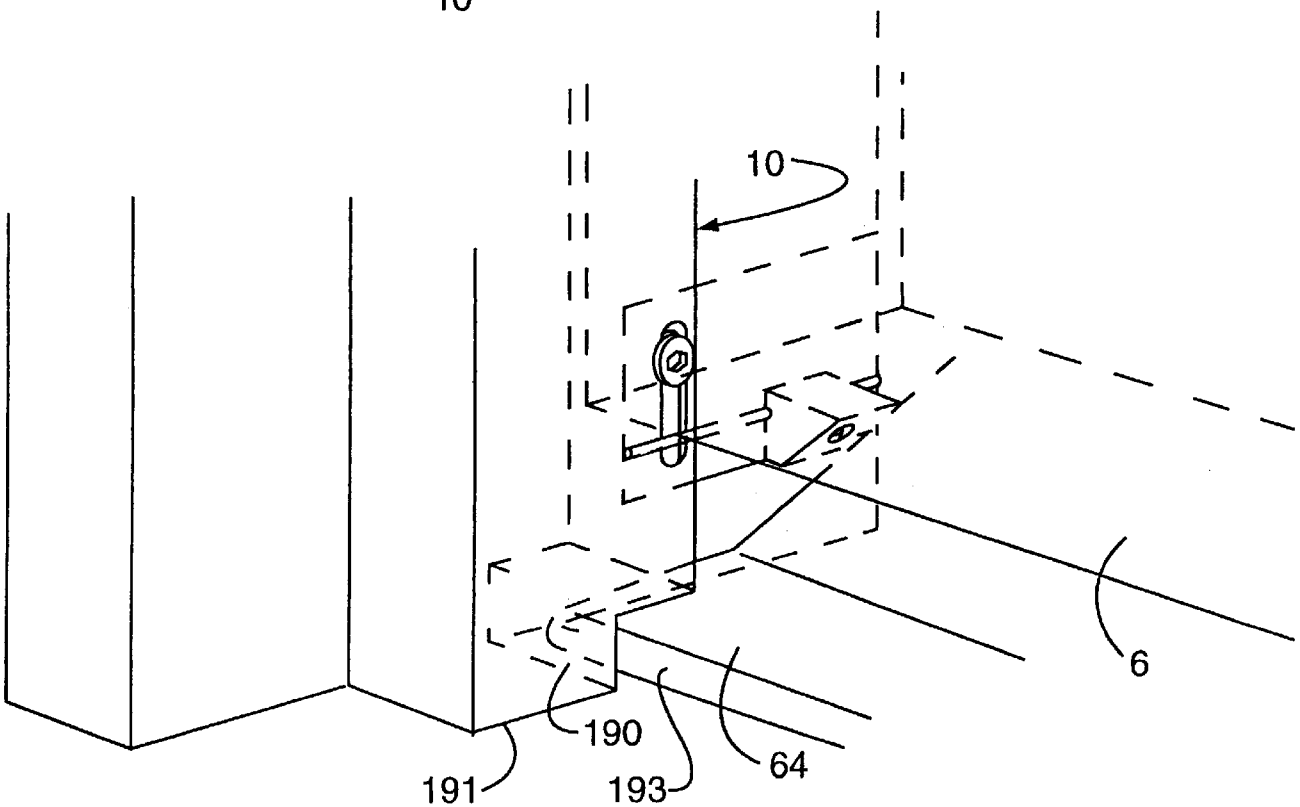

FIG. 40 is a perspective view of an embodiment similar to that of FIGS. 38–39 except that the recess is designed differently so that it is formed in both the soffit and the stop surfaces.

Figure 41:
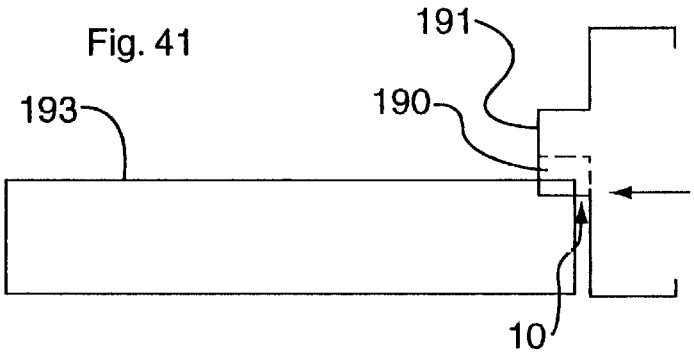

FIG. 41 is a top elevational view of the system of FIG. 40 illustrating the security flap with its distal end tucked into the recess in the stop/soffit as shown in FIG. 40.

Figure 42:
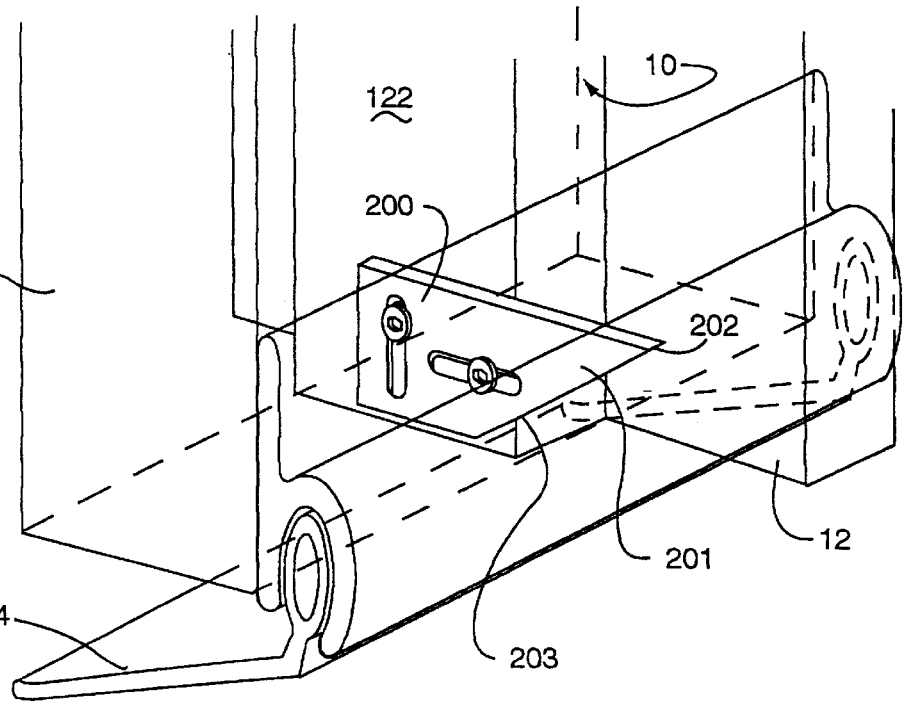

FIG. 42 is a perspective view illustrating a spring-actuated security flap according to another embodiment of this invention wherein the actuating cam is mounted on the soffit of the door frame.

Figure 43:
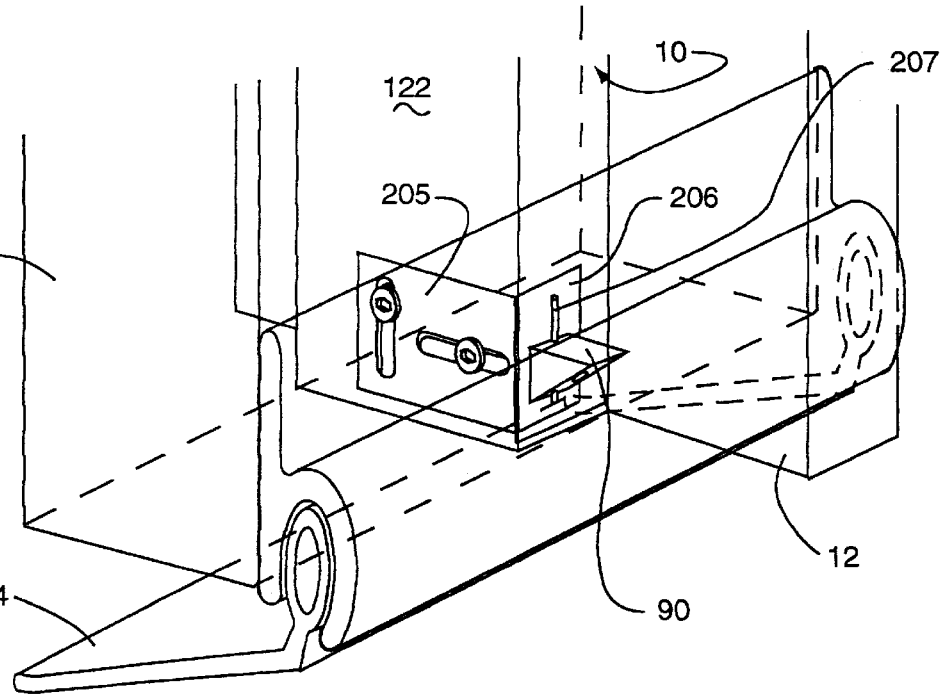

FIG. 43 is a perspective view illustrating a spring-actuated security seal system according to still another embodiment of this invention, wherein the actuating cam is mounted on the stop of the door frame.

Figures 44, 45:
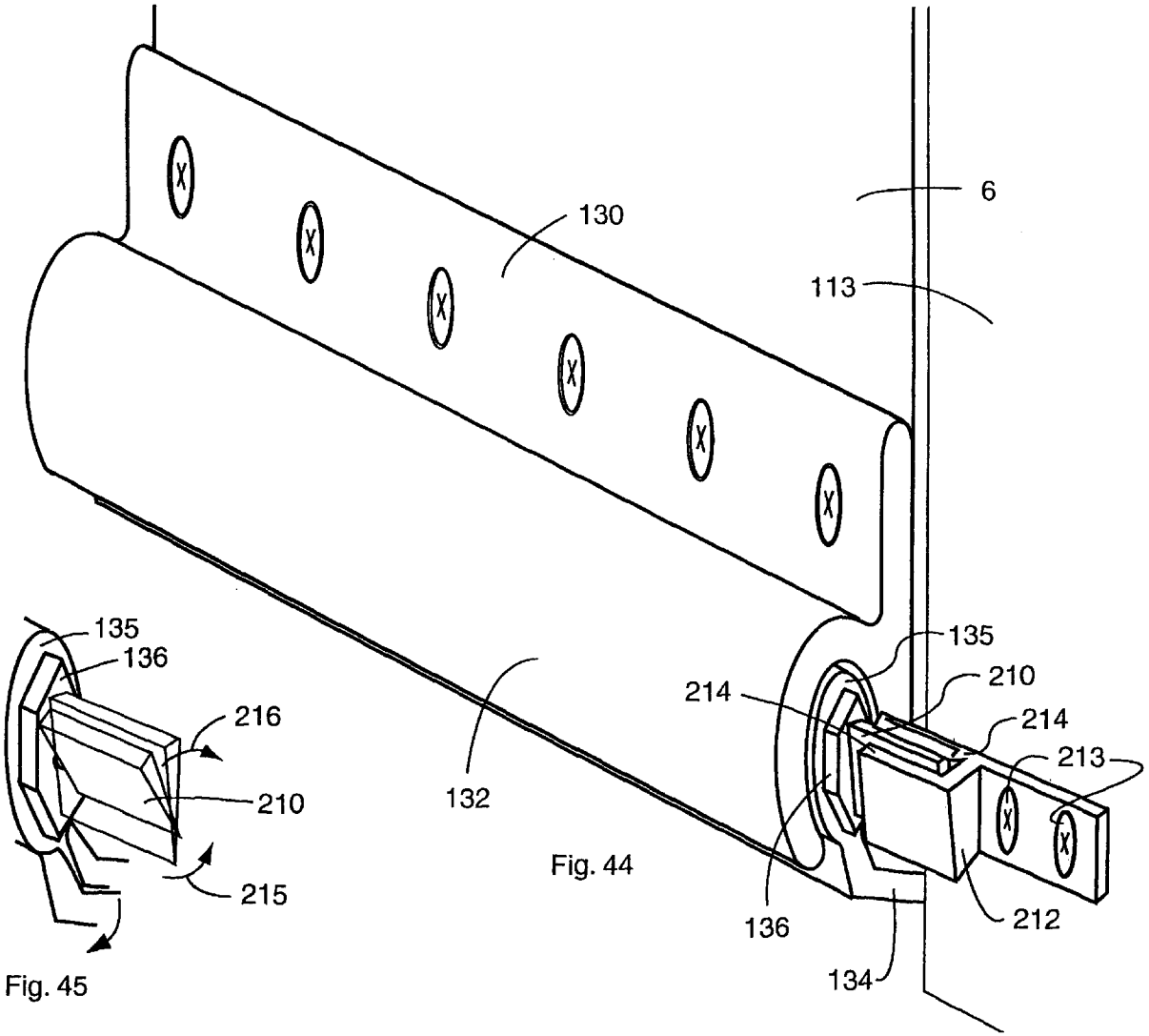

FIG. 44 is a perspective view illustrating a security seal according to another embodiment of this invention.

FIG. 45 is a schematic diagram illustrating rotation of the projection extending from the end of the flap in FIG. 44 during opening/closing of the door.

Figure 46:
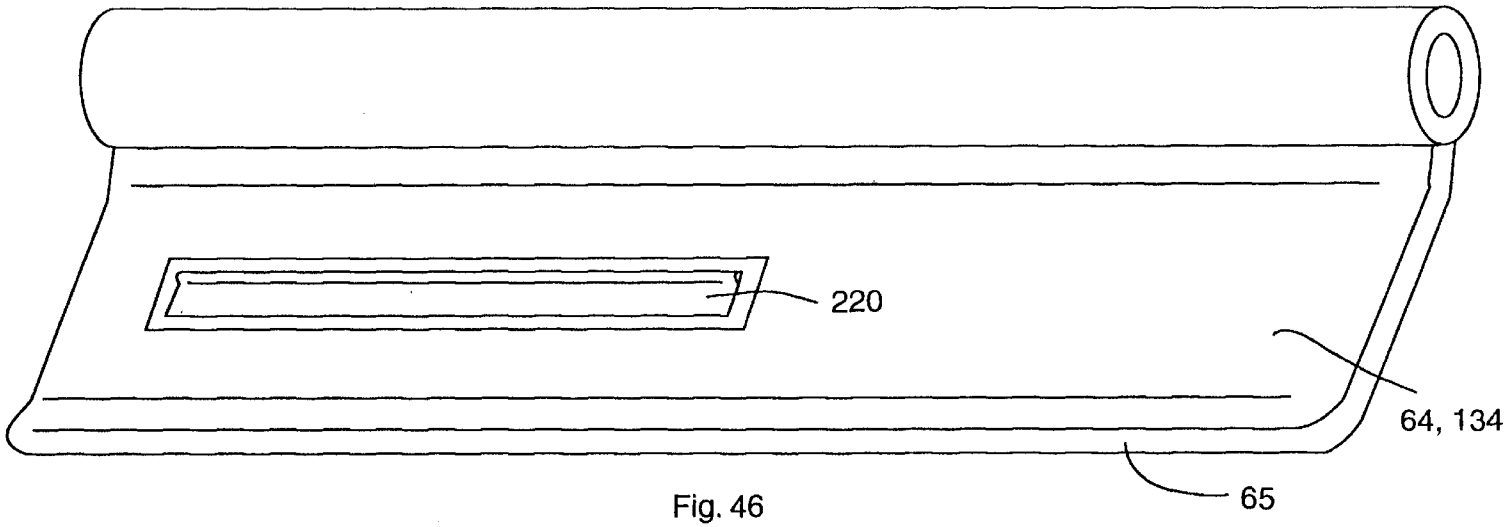
Figure 47:
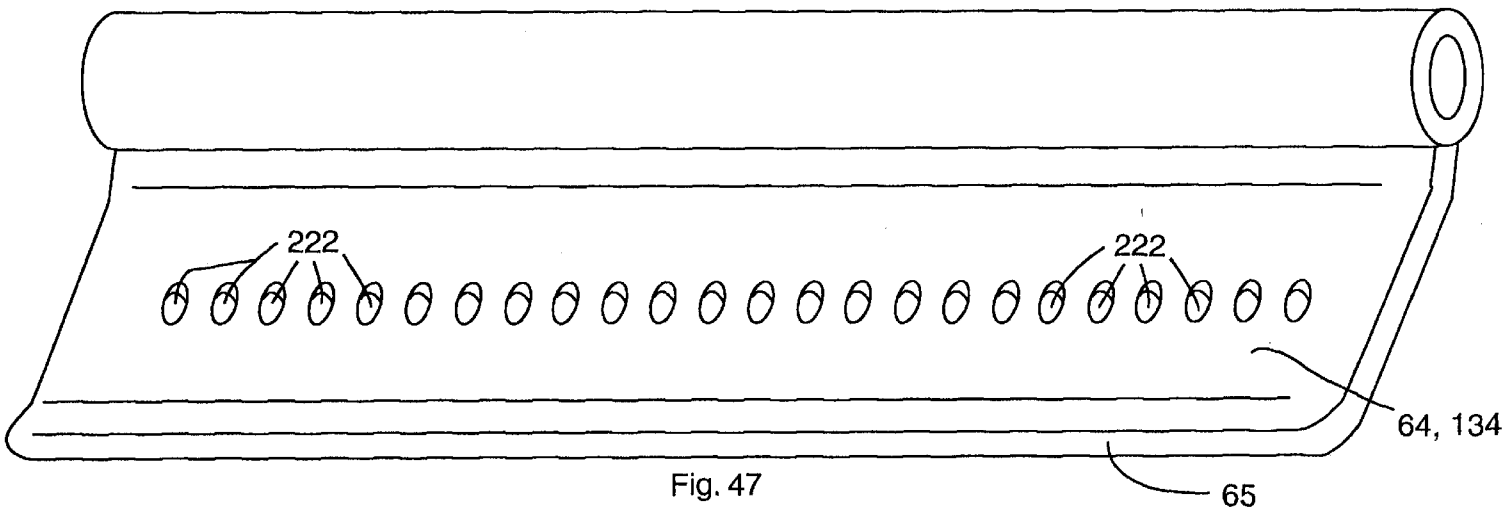

FIGS. 46–47 are perspective views illustrating security flaps for improved make-up air circulation according to different embodiments of this invention.

Figure 48:
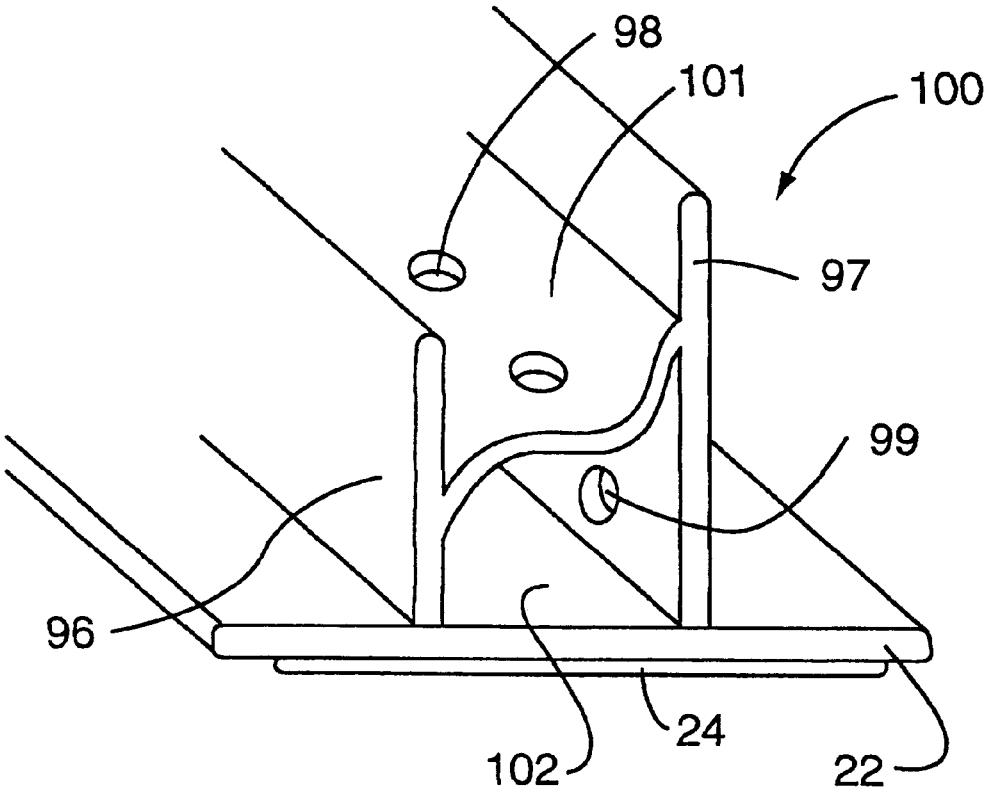

FIG. 48 is a perspective view illustrating a multi-finger frame seal according to a different embodiment of this invention.

Figure 49:
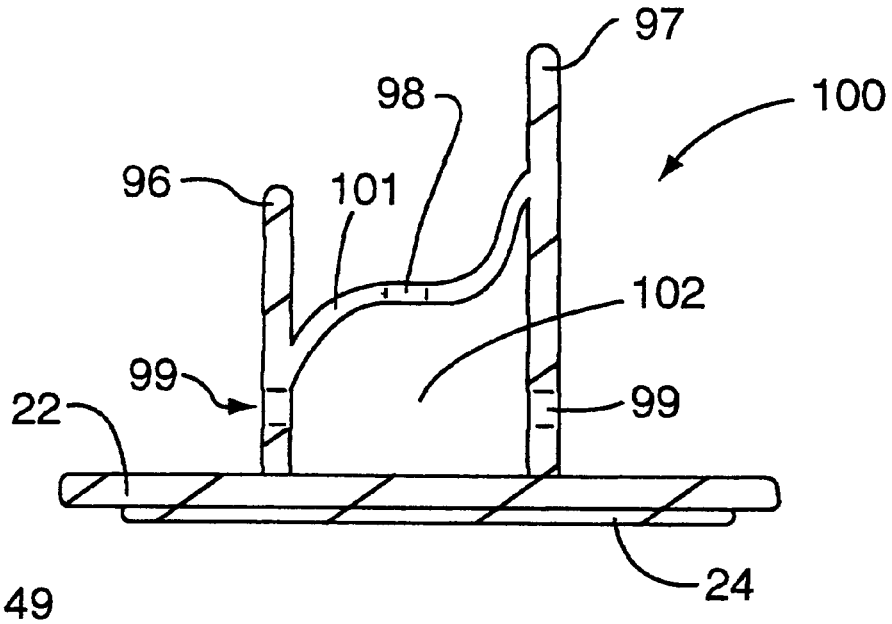

FIG. 49 is a side elevational cross-sectional view of the FIG. 48 frame seal.

Figure 50:
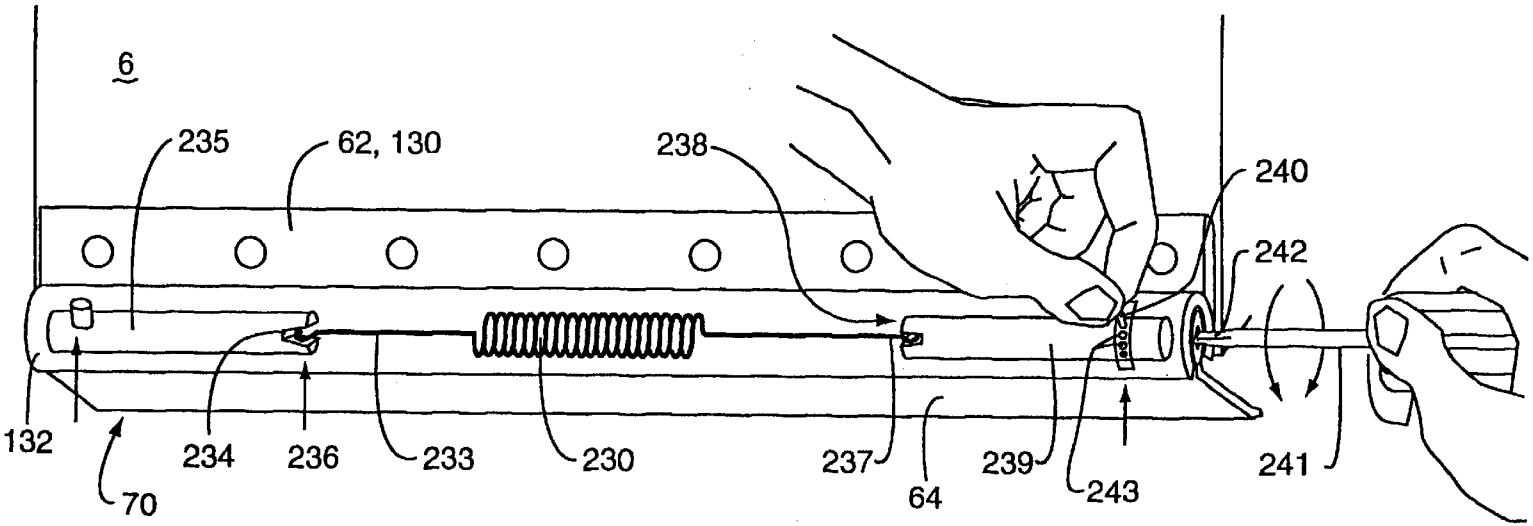
Figure 51:
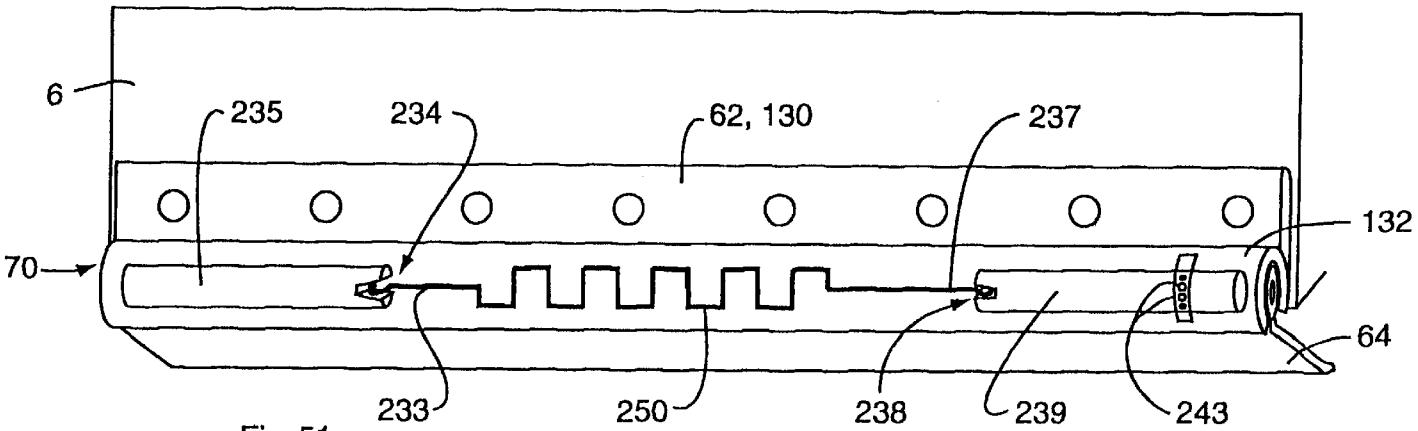

FIGS. 50–51 are perspective views illustrating a spring system for use in any of the spring-actuated security seals discussed above according to different embodiments of this invention.

Figure 52:
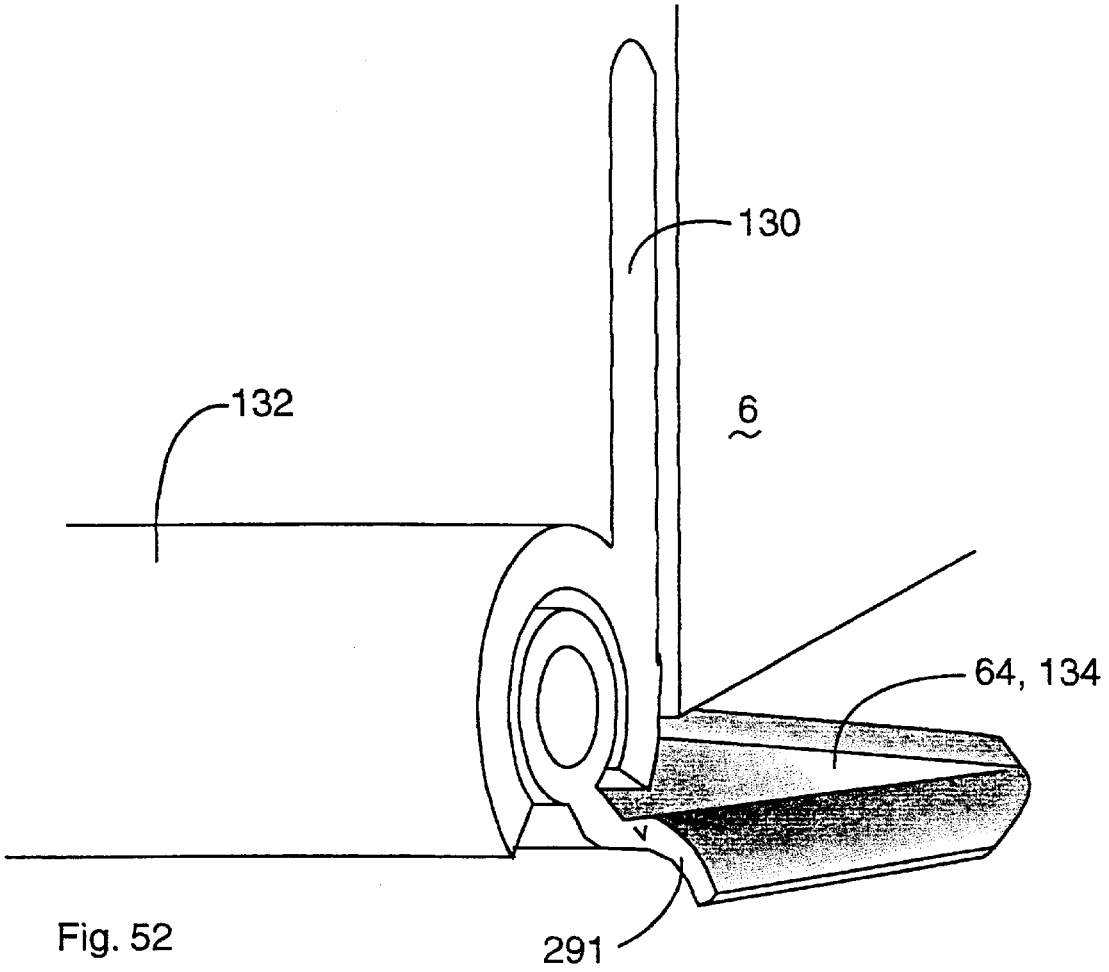

FIG. 52 is a perspective view illustrating the edge of the security flap angled downward adjacent the cam.

Figure 53:
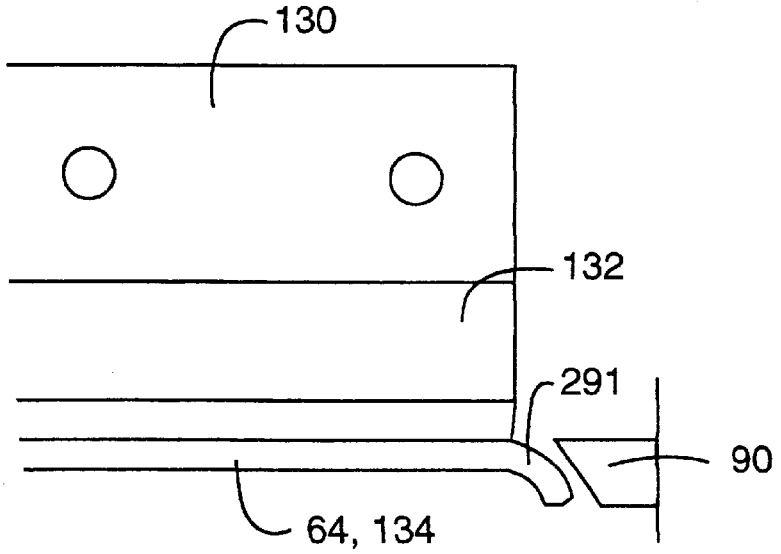

FIG. 53 is a side view illustrating the FIG. 52 security flap as viewed from inside of the dwelling, this Figure illustrating the edge of the flap closest the cam being angled downward.

DETAILED DESCRIPTION OF CERTAIN EMBODIMENTS OF THIS INVENTION

Referring now more particularly to the following drawings in which like reference numerals indicate like parts throughout the several views.

Figure 1:
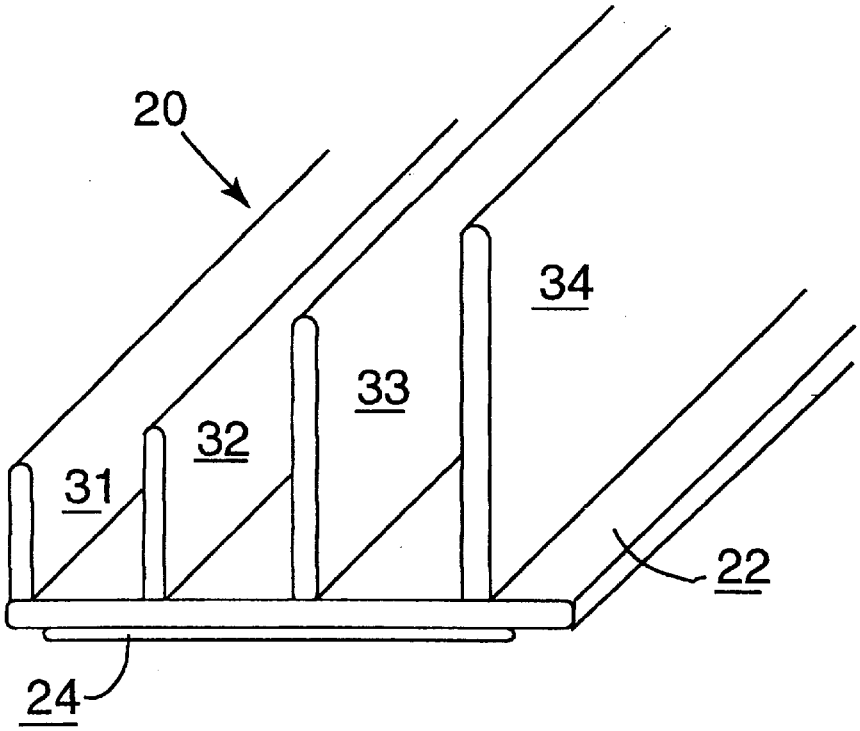
FIG. 1 is a perspective view of a multi-finger frame seal for affixation to a door frame surrounding a door.

FIG. 1 is a perspective view of multi-finger frame seal 20 which includes substantially planar elongated base 22, as well as a plurality of flexible fingers 31, 32, 33, and 34 mounted on and extending therefrom. As shown, first finger 31 is shorter than second finger 32 which is shorter than third finger 33, which in turn has a shorter length from base 22 than fourth finger 34. Pressure sensitive tape or adhesive 24 may be applied to the under or rear side of base 22 for the purpose of affixing multi-finger seal 20 to a door frame. When frame seal 20 is affixed to a door frame adjacent a door, it is oriented so that when the door is closed, the door first comes into contact with first finger 31 and thereafter contacts fingers 32, 33, and 34, respectively.

Figure 2:
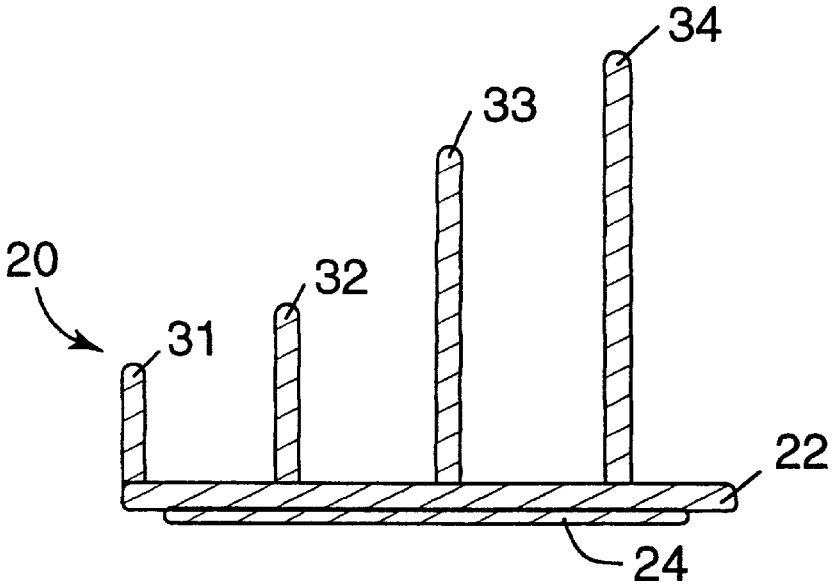
FIG. 2 is a side elevational cross-sectional view of the multi-finger frame seal of FIG. 1, this figure illustrating four separate flexible fingers attached to the base portion.
Figure 2A:
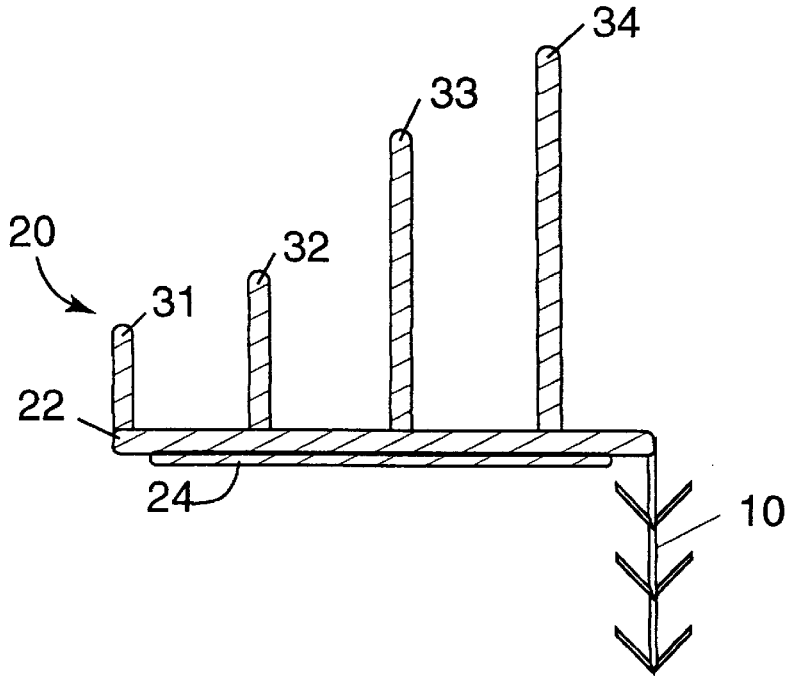
Figure 2B:
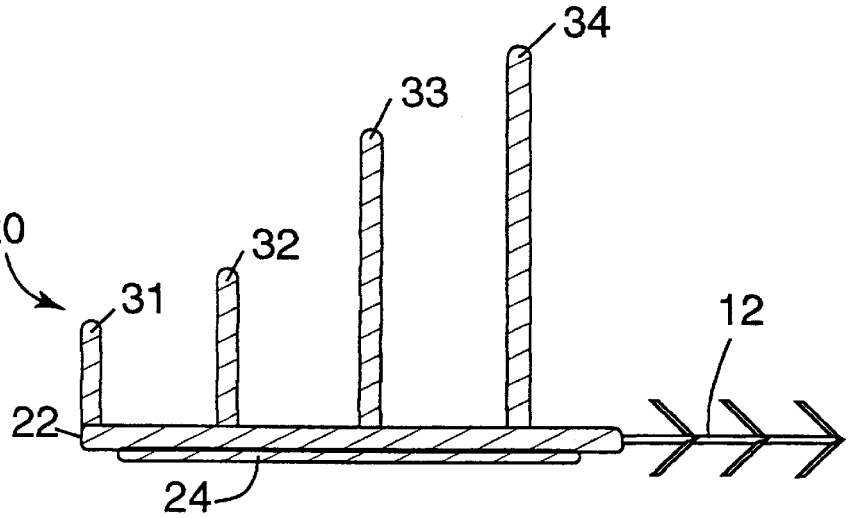

FIG. 2 is a side elevational cross-sectional view of multi-finger frame seal 20. As illustrated, the distance between first finger 31 and second finger 32 is such that upon bending of finger 31 as caused by closure of a door, first finger 31 does not contact any portion of second finger 32. Second, third, and fourth fingers 32–34, respectively, are spaced from one another along base 22 such that when the door closes, they will contact one another. Base 22, as well as the fingers of frame seal 20, may be formed of a material such as Santoprene™. Further description of frame seal 20 may be found in commonly owned copending Ser. No. 08/258,528, the disclosure of which is incorporated herein by reference.

FIG. 2(*a*) is a side cross-sectional view of frame 20 which differs from FIGS. 1–2 in that kerf 10 is attached or affixed to an edge of base 22 so that seal 20 may be attached to the door frame hinge jamb. Kerf 10 is designed so as to fit into an aperture defined in the jamb so as to more securely affix seal 20 to the door frame along the hinge jamb.

FIG. 2(*b*) is a side cross-sectional view of multi-finger frame seal 20 which differs from the FIGS. 1–2 embodiment in that kerf engaging tab 12 is affixed to base 22 at an edge thereof for the purpose of securing seal 20 to the door frame lock jamb. In FIG. 2(*b*), kerf 12 is substantially coplanar with base 22 because base 22 on the lock jamb is to be secured to the rabbett. This configuration differs from FIG. 2(*a*) where kerf 10 is substantially perpendicular to base 22 because on the hinge jamb, base 22 is to be affixed to the stop.

Figure 3:
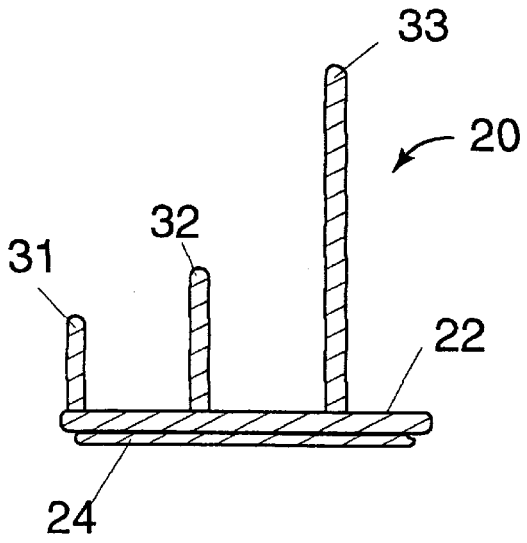
FIG. 3 is a side elevational cross-sectional view of a multi-finger frame seal similar to that shown in FIG. 1 except that it only includes three flexible fingers.
Figure 3A:
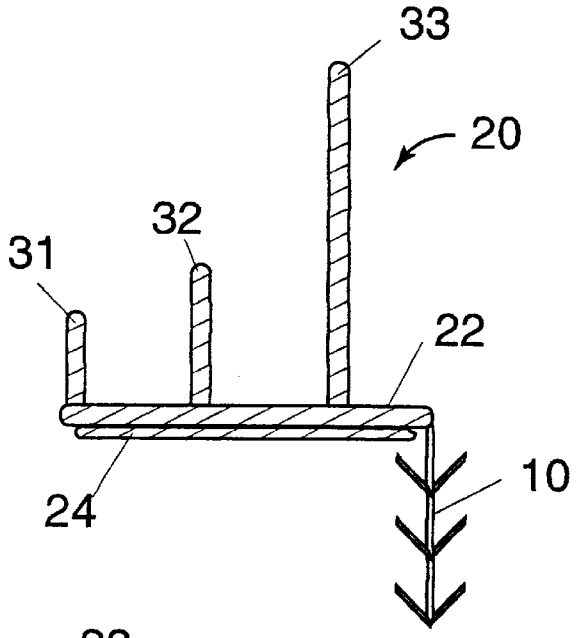
Figure 3B:
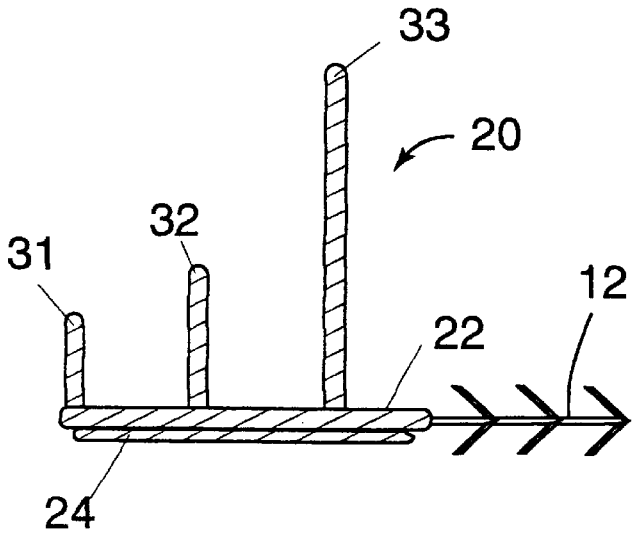

FIG. 3 is a side cross-sectional view of another multi-finger frame seal 20 which differs from the FIGS. 1–2 embodiment in that only three flexible fingers 31–33 are provided on base 22. FIGS. 3(*a*) and 3(*b*) are side cross-sectional views of a three finger seal 20 having kerfs 10 and 12, respectively, in a manner similar to that discussed above with respect to FIGS. 2(*a*) and 2(*b*). The three fingers 31–33 of the frame seals shown in FIGS. 3–3(*b*) are provided on base 22 so that when the door closes, first finger 31 will not contact finger 32, but finger 32 will contact finger 33.

Figure 4:
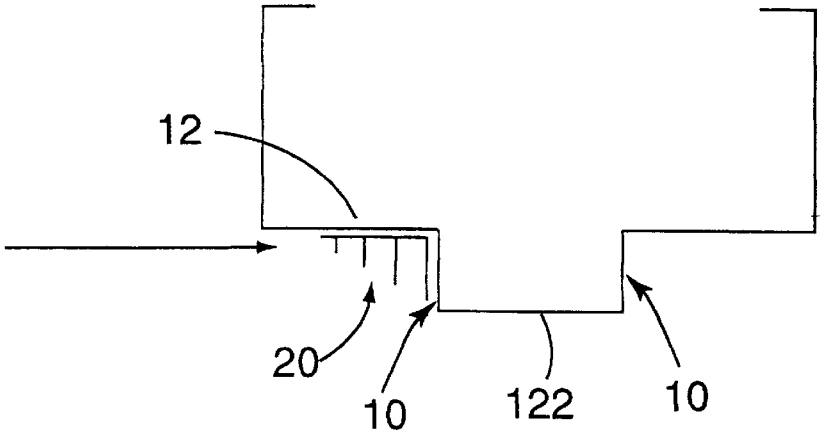
FIG. 4 is a top plan view illustrating the multi-finger frame seal of FIGS. 1, 2, or 3 affixed to the lock jamb of the door frame.
Figure 5:
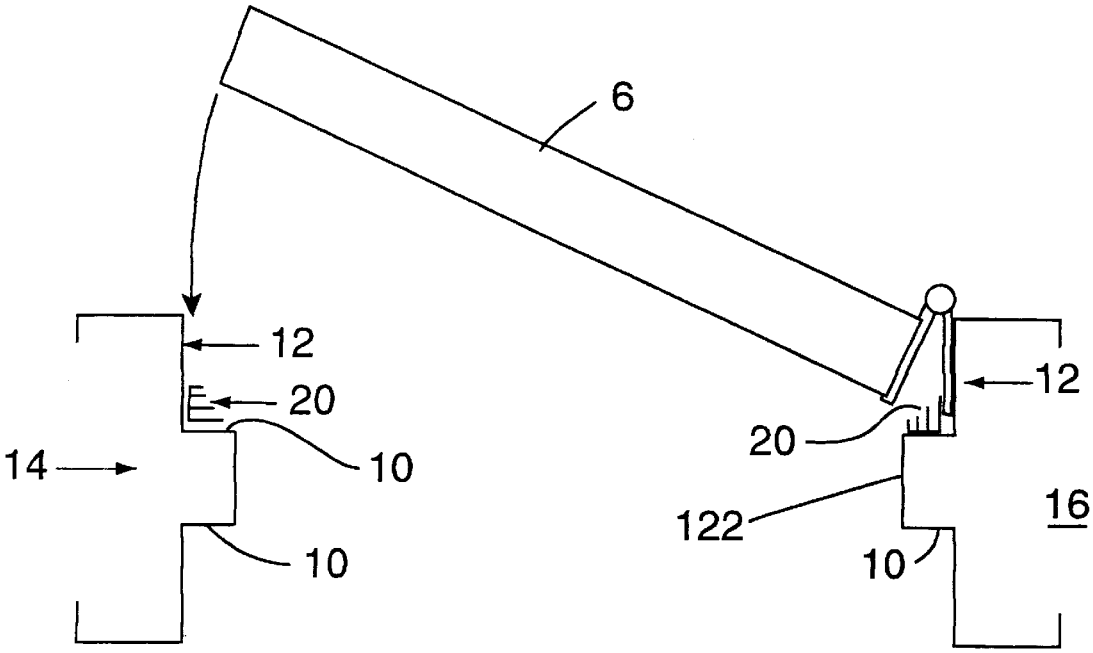
FIG. 5 is a top plan view illustrating the operable orientation of the multi-finger seal of either FIGS. 1, 2, or 3 on both the lock and hinge jambs of the frame surrounding the door, the door being shown closing by way of an arrow.

FIG. 5 is a top view illustrating any of the above frame seals 20 attached to the door frame surrounding door 6. The door frame surrounding door 6 includes vertically extending lock jamb 14 and hinge jamb 16 which are attached at their respective tops by a header. On lock jamb l4, multi-finger seal 20 is affixed on rabbett 12 so that the fingers of seal 20 extend toward hinge jamb 16 when door 6 is in an open position. When door 6 closes as illustrated in FIG. 5, the door first comes into contact with first finger 31, and thereafter fingers 32, 33, and 34, respectively. FIG. 4 is a top view illustrating seal 20 affixed to lock jamb 14 in an enlarged manner.

Meanwhile, on the hinge jamb 16 side, multi-finger frame seal 20 has its base 22 attached to stop 10 so that as door 8 closes, it first contacts first finger 31 and thereafter the remaining fingers in the same order as occurs on the lock jamb side. Thus, frame seal 20 is oriented differently on the lock and hinge jambs. Seal 20 is affixed to the rabbett on the lock jamb side and to the stop surface 10 closest the door on the hinge jamb 16 side. This provides for substantially no hinge bind during closing of the door. Additionally, the multi-finger seals 20 on the hinge and lock sides of the door frame may be part of a single integrally formed seal 20 which is U-shaped, the vertically extending hinge and lock jamb portions shown in FIG. 5 being interconnect across the top of the door frame by another multi-finger seal portion.

FIGS. 48–49 illustrate perspective and side cross-sectional views respectively of a two finger frame seal 100 according to an embodiment of this invention. Frame seal 100 is to be affixes to the door frame as shown in FIG. 5 (i.e. similar to frame seal 20). Frame seal 100 differs from seal 20 in that i) seal 100 has only two fingers; and ii) seal 100 includes bridge 101 disposed between and connecting flexible fingers 96 and 97 for the purpose of creating an air cushion seal. Bridge 101 is spaced from base 22 thereby defining elongated air gap or opening 102 therebetween. Gap 102 extends along the entire length of base 22 in between fingers 96 and 97 as defined by flexible bridge 101. The provision of bridge 101 with its air relief apertures 98 defined therein allows seal 100 to function as an air cushion when door 6 is closed. Apertures 98 in bridge and aperture(s) 99 in the flexible fingers extending from base 22 allow seal 100 to function as an air cushion against shutting door 6 whereby the fluid (e.g. air or gas) within space 102 is forced out of the space 102 at a predetermined rate. The rate at which the fluid (e.g. air) is forced from space 102 is dictated by the number and size of apertures (98, 99). Accordingly, when door 6 closes, it first contacts finger 96 and forces it toward finger 97 thereby compressing space 102. The air within space 102 cushions the door while the air is expounded from the space through the apertures 98, 99, thereby resulting in a smoother closing of door 6. According to certain other embodiments of this invention, apertures 98, 99 need not be provided as the fluid such as air within space 102 may be forced from the space at an end or ends of the seal. It is noted that bridge 101 could also be implemented into three or four finger frame seal 20, with the bridge being disposed between either all fingers or only a select pair of flexible fingers.

The FIGS. 48–49 embodiment also shows that frame seals according to this invention may include just two fingers, instead of three or four. The two finger seal of this embodiment does not create a predetermined sound upon opening of door 6. The sound created upon opening of door 6 (described in the parent application) depends upon the height and spacing of the fingers. For example, the sound would be enabled if a small third fin or finger were to be added to the FIGS. 48–49 frame seal.

FIGS. 6–25(*a*) disclose different embodiments of a spring loaded security seal for positioning at the bottom side or underneath of door 6. The purpose of such a security seal underneath the door is to prevent burglars and the like from breaking into a room or dwelling by accessing the door locking mechanisms and the like from underneath the door.

The FIG. 6 security seal 60 may be attached to door 6 at a variety of locations, as dictated by the specific door design. Door engaging portion 62 of security seal 60 may be disposed along and affixed to the interior or inside surface of door 6 as shown in FIG. 7, along the bottom of the door as shown in FIG. 8, or alternatively within a recess in the bottom of a door as shown in FIG. 9.

Door engaging portion 62 of security seal 60 is preferably attached to the inside or Eecurity side of door 6 as shown in FIGS. 7 and 10. Door engaging portion 62 is attached at a location which is inaccessible from the outside. Door engaging portion 62 is attached to door 6 so that security flap 64 is movable from an open door (non-secured) position substantially parallel to and adjacent the bottom of door 6 (see FIG. 7) to a secured or door closed position (e.g. see FIG. 11) wherein security flap 64 is pivoted downward about hinge 70 so as to be close to or actually in contact with the floor or ground thereby securing the dwelling against unwanted entry. In the door closed position (e.g. FIG. 8 and FIG. 11), the distal end or free edge 65 of flap 64 may contact the floor.

Hinge 70, of course, may be any type of known hinge (e.g. living hinge) and optionally may be located in a recess defined by the door so as to not extend or project outwardly from door 6.

As shown in FIG. 8, when door engaging portion 62 is affixed to the bottom side of door 6, flap 64 is substantially parallel thereto when the door 6 is opened, with flap 64 pivoting downward about hinge 70 when the door is closed. In FIG. 9 when door engaging portion 62 is affixed to the upper side of the recess defined in the underneath side of the door, security flap 64 is, again, substantially parallel to portion 62 when door 6 is in an open position. When door 6 is closed, flap 64 is forced to or permitted to pivot downward about hinge 70 to the door closed position as shown in FIG. 9.

As shown in FIG. 10, the distal end of flap 64 is angled upward at 65 so as to permit the security flap to slide more easily along rugs, hardwood floors, and the like.

Because the security seal of FIGS. 6–11 is spring-biased into its door open position (see FIG. 7), the flap actuating cams shown in FIGS. 12–25(*a*) are required for forcing flap 64 downward into the secured position when door 6 is closed. FIG. 12 illustrates flap actuating cam 90 attached to and protruding from rabbett 12 of the door frame on the interior or secured side of stop 10. FIG. 13 illustrates an alternative embodiment of flap actuating cam 90 non-adjustably affixed to rabbett 12. The positioning of cam 90 in both FIGS. 12 and 13 is such that when door 6 is swung closed, cam engaging surface 68 of flap 64 comes into contact with cam 90 thereby forcing flap 64 downward into contact with the floor placing the security seal in the secured position. When door 6 is opened, flap 64 is biased upward into the FIG. 7 position (door open position) as there is no longer contact with cam 90.

Figure 14:
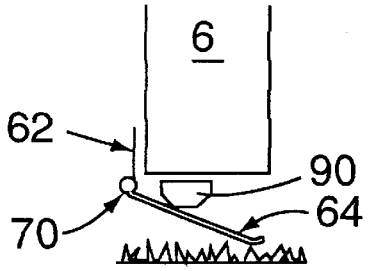
FIG. 14 is a side elevational cross-sectional view of the security seal of FIG. 6 in the door closed position when the actuating cam is in contact with the security flap maintaining it in the secured position.
Figure 15:
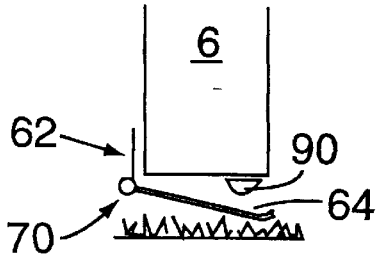
FIG. 15 is a side elevational cross-sectional view illustrating the security seal of FIG. 6 in the door closed position with the cam in an alternative position.
Figure 16:
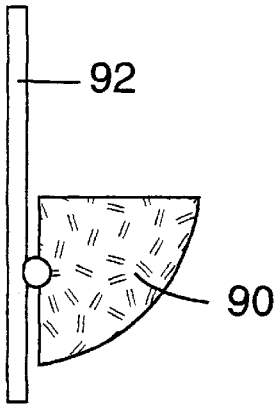
FIG. 16 is an elevational view of an alternative cam configuration.
Figure 17:
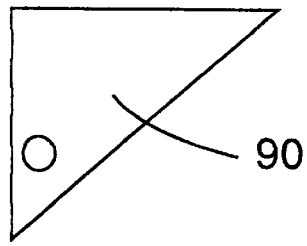
FIG. 17 is an elevational view of yet another alternative cam configuration, both the FIG. 16 and FIG. 17 cams being usable in conjunction with the FIG. 6 spring-biased security seal.

FIG. 14 is a side view of door 6 having security seal 60 attached thereto in the closed position so that flap 64 is contacting or close to contacting the floor or ground. As shown, cam 90 is in contact with flap 64 thereby forcing it against the spring bias force downward into the secured position. FIG. 15 illustrates that both the location of cam 90 on the rabbett and the size of cam 90 are adjustable for the purpose of changing the timing of cam engagement with flap 64 and the distance that flap 64 is forced downward when the door is closed. FIGS. 16–17 illustrates alternative designs for cam 90.

Cam 90 is affixed to door frame 8 and preferably to rabbett 12 on hinge jamb 16, and is aligned to engage cam following surface 68 of security flap 64 such that upon closing the door, the cam following surface contacts the cam and the security flap is forced downward away from the door to contact the floor. Cam 90 functions as a security wedge to dispose and maintain the security seal in the door closed position. As shown in FIGS. 16–17, cam 90 may be formed as an arc of a sphere or circle, a spiral, french curve, etc. While cam 90 is preferably mounted on the hinge jamb, it may alternatively or additionally be mounted on the lock jamb. The specific curve or shape of the contacting surface of cam 90 and the shape of cam following surface 68 on the flap are related and, at least partially, dictate the desired position of cam 90 on the door frame.

Figure 18:
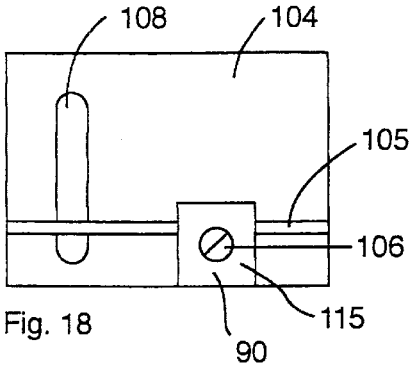
FIGS. 18–19 illustrate still another embodiment of a security seal actuating cam and corresponding bracket to be affixed to the door frame for the purpose of actuating a spring loaded security seal to the secured position.
Figure 19:
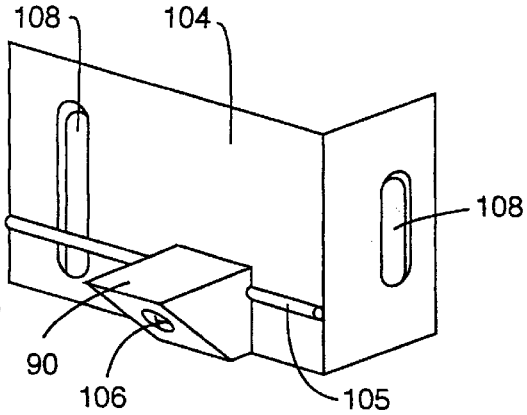

FIGS. 18–24 illustrate different embodiments of flap engaging cam 90 (for use with the spring-biased security seals of this invention) which are preferably affixed to the hinge jamb, but may instead or additionally be affixed to the lock jamb. As shown in FIGS. 18–19, cam 90 is affixed on mounting bracket 104. Pin or projection 105 is formed integrally with or on bracket 104 so that cam 90 may be adjustably positioned along the length of pin 105. Accordingly, in order to move cam 90 from one position to another along pin 105, the user loosens screw 106, slides cam 90 along pin 105 to the new position, and thereafter tightens screw 106 which locks cam 90 to a particular position on bracket 104. Bracket 104 is affixed to the door frame as shown, for example, in FIG. 12. Elongated apertures or holes 108 are provided in bracket 104 so that its vertical position on the door frame may be adjusted. Cam 90 and bracket 104 are preferably affixed to the door frame by way of screws inserted through apertures 108 (e.g. see FIG. 22). Apertures 108 may also be used for allowing an installer of the system to view alignment marks mades on the door frame thereby enabling easier installation.

Figure 20:
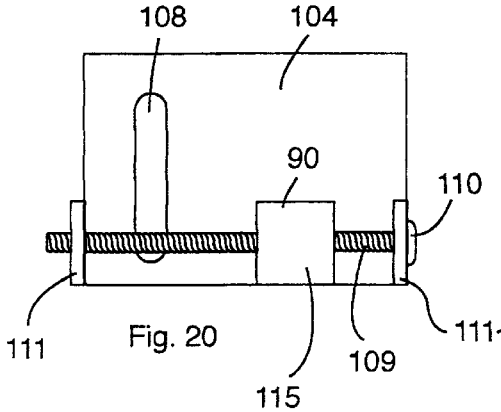
FIGS. 20–21 illustrate a security seal actuating cam and corresponding bracket to be affixed to a door frame similar to that shown in FIGS. 18–19, except that a cam is mounted on a screw thereby enabling lateral adjustment of the cam so that the time at which the flap is actuated during door closing and/or opening may be adjusted.
Figure 21:
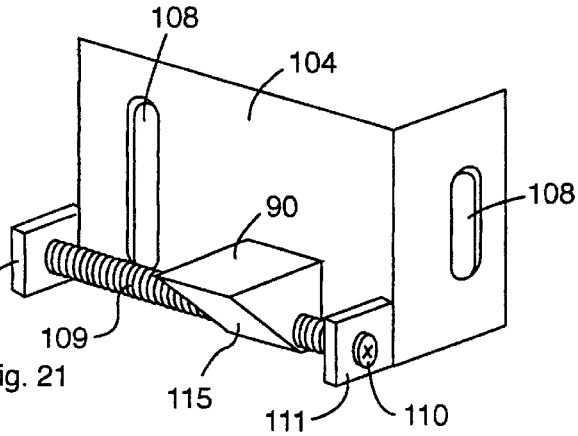

FIGS. 20 and 21 illustrate another embodiment of the cam for actuating flap 64 of the security seal. As shown, cam 90 is attached to screw 109 so that mere turning of the screw by a user at screwhead 110 causes cam 90 to move horizontally along the screw. Screw 109 is affixed to bracket 104 by way of screw mounting members 111, with bracket 104 and the cam being affixed to the door frame as discussed above.

Figure 22:
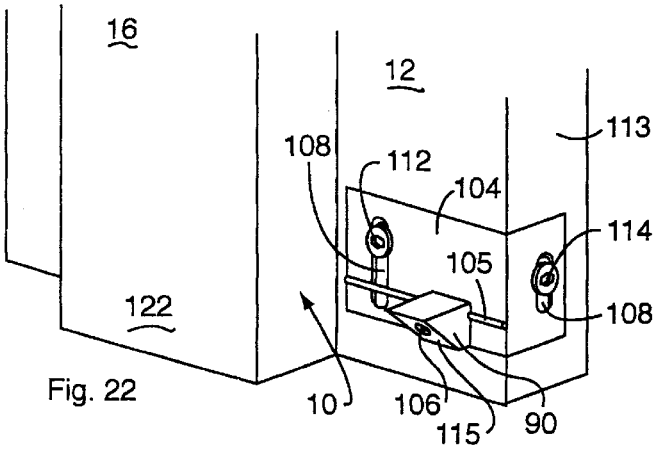
FIG. 22 is a perspective view illustrating the actuating cam and corresponding bracket of FIGS. 18–19 affixed to a door frame.

FIG. 22 is a perspective view illustrating the security seal cam system of FIGS. 18–19 affixed to the door frame. As shown, the main portion of bracket 104 is attached to the front face of rabbett 12 on the interior side of the stop by way of screw 112. Meanwhile, the other portion of bracket 104 which is angled 90° backward from the main portion is affixed to inside frame face 113 by way of tamper-proof screw 114. Accordingly, as door 6 with security seal 60 affixed thereto is closed, surface 68 of flap 64 comes into contact with angled surface 115 of cam 90 so that flap 64 is forced downward against the spring bias into the secured position as the door closes.

It is to be pointed out that according to alternative embodiments, cam 90 may be affixed to the security flap so as to contact the door frame when the door closes and causes the flap to pivot downward.

Figure 23:
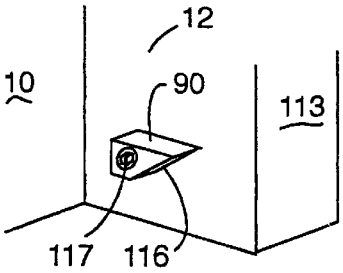
FIG. 23 illustrates yet another embodiment of a security seal actuating cam affixed to a door frame.

FIG. 23 illustrates another embodiment of a security flap actuating cam affixed to rabbett 12 (lock or hinge jamb). As shown in FIG. 23, cam 90 is affixed to the rabbett so that portion 68 of flap 64 comes into contact with surface 116 of the cam as the door is closing thereby forcing flap 64 downward into the secured osition. Screw 117 or any other conventional fastener functions to hold cam 90 to rabbett 12 in a secured position.

Figure 24:
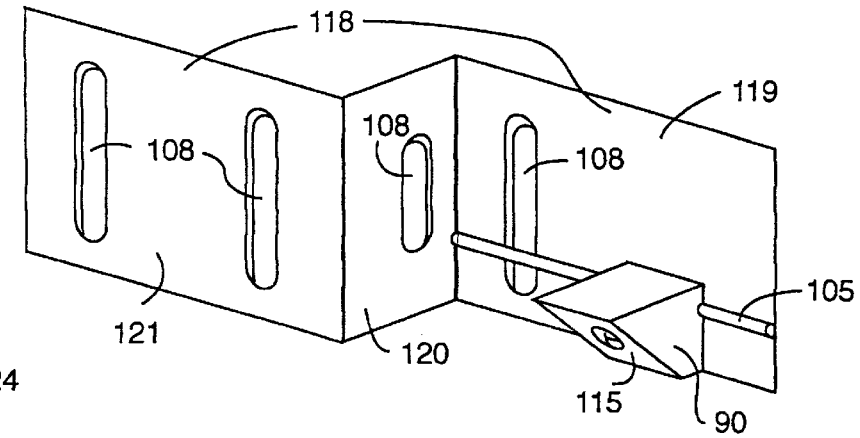
FIG. 24 is a perspective view illustrating a further embodiment of a security seal actuating cam and corresponding bracket, this embodiment differing from the FIGS. 18–19 embodiment in that it includes three surface bracket members angled relative to one another to be mounted in different areas.

FIG. 24 is a perspective view illustrating another embodiment of a security seal cam actuating system in which bracket 118 is provided with three sections angled relative to one another. Section 119 of bracket 118 is affixed directly to rabbett. 12, with section 120 being affixed to stop 10 and section 121 being attached to and flush with soffit 122. Again, apertures 108 are provided in bracket 118 so that the system may be affixed to the door frame. The position of cam 90 may be adjusted on portion 119 by way of moving the cam laterally along pin 105 as discussed above with respect to FIGS. 18–19.

FIG. 25(*a*) is a perspective view illustrating the FIGS. 18–19 cam system affixed to the door frame when door 6 is in the closed position. As shown, security flap 64 is in contact with cam 90 and is therefore forced downward into the secured position against the bias of the spring. Distal end 65 of flap 64 is angled upward with respect to the main portion thereof so as to enable the flap to slide more easily along carpets and the like. As door 6 is opened, cam engaging edge 68 of flap 64 will slide along cam 90 until the portion adjacent distal end 65 is no longer in contact with the cam. Thereafter, flap 64 is spring-biased upward so that it is substantially parallel to the bottom of door 6.

FIGS. 25(*b*)–25(*c*) illustrate another embodiment of this invention where the distal end of security flap 64 includes portion 300 angled downward toward the floor and portion 301 angled upward. Portion 300 contacts cam 200 during door 6 opening and closing, while portion 301 is angled upward to enable easy sliding of the flap over rugs and the like. Flap distal end portions 300 and 301 are angled in opposite directions relative to the main body of the flap 64.

FIGS. 26–31 illustrates a security seal system to be positioned adjacent the bottom of door 6, this system differing from the security seal discussed above in that the system of FIGS. 26–31 is gravity-actuated.

FIG. 26 is a perspective view illustrating a gravity-actuated security seal system for attachment adjacent the bottom of door 6. As illustrated, door engaging portion 130 is affixed to the interior side of door 6 by way of screws 131 or any other type of conventional fastener. Integrally formed with door engaging portion 130, according to this embodiment, is elongated quasi-circular housing 132 which extends across the interior surface of door 6 between the hinge and lock jambs. Security flap 134, shown in FIG. 26 in the secured door closed position, is pivotally attached within housing 132 (i.e. hinge arrangement). Connected to security flap 134 is elongated core member 135 which is maintained within housing 132 by way of hex fasteners 136 on either end of the housing. Also utilized in this embodiment is flap actuator or cam 137 which functions to raise flap 134 upward from the ground as door 6 is opened. Actuator or cam 137 is affixed to inside frame face 113 and/or the floor by way of fasteners extending through apertures 138 and/or 139, respectively.

A typical operation of the gravity-actuated security seal of FIG. 26 will now be described. As illustrated in FIG. 26, security flap 134 is in the secured or down position so that the distal end of flap 134 is either in contact with the floor or substantially close thereto. For the purpose of this description, we will assume that actuator 137 is affixed to the inside frame face on the hinge jamb side of the door frame, although it is possible to be affixed to the other side. As door 6 is opened, the lower surface of security flap 134 slides along actuator or cam 137 thereby forcing security flap 134 to pivot upward out of contact of the floor until flap 134 is substantially parallel to the ground. This pivoting of flap 134 is permitted by way of core 135 pivoting within housing 132. Flap 134 is permitted to pivot upward until the flap comes into contact with area 140 of housing 132. The flap is maintained in this non-secure or upward pivoted position while door 6 remains open. When door 6 is closed, the bottom of flap 134 slides along the top of actuator 137 from its distal end toward the end closest core 135 which causes flap 134 to pivot downward away from the door bottom and into the secured position as the door is closed.

FIGS. 27–28 illustrate a different embodiment of an actuator which may be used in conjunction with the FIG. 26 system. FIG. 28 illustrates the actuator 137 shown in FIG. 26, which is affixed to either the floor or the inside frame face 113. Rounded projection portion 142 is the primary cam surface of the actuator which is contacted by flap 134 during the opening and closing of door 6. FIG. 27 is a top view of the FIG. 26 and FIG. 28 actuator.

FIG. 29 is a perspective view of the gravity-actuated security seal system of FIG. 26 except that flap 134 locking member 145 is also provided. According to the FIG. 29 embodiment, locking member 145 includes a projection which extends into the doorway from the portion of actuator 137 affixed directly to inside frame face 113. This projection 145 functions to maintain or lock security flap 134 in the secured position when door 6 is closed. The size and positioning of member 145 are such that flap 134 is still permitted to pivot upward out of the secured position when door 6 is opened (but not when the door is closed) as flap 134 slides along portion 142 of actuator 137.

FIG. 30 is a perspective view illustrating the gravity-actuated security seal of FIG. 26 except that actuator 137 is replaced with adjustable actuator 147 which is affixed to the floor by way of fastener 148. In the FIG. 30 embodiment, flap 134 remains pivoted downward so as to be in contact with the floor or close thereto, when door 6 is in the closed position. However, when the door is opened, the underneath side of flap 134 slides along the top surface of actuator 147 resulting in flap 134 being pivoted upward about the core 135 axis into a non-secure position substantially parallel to the bottom of the door. The bottom side of flap 134 remains in contact with the top of actuator 147 while door 6 is open, thereby maintaining flap 134 in a non-secured position out of contact with the ground or floor. As door 6 is closed, gravity causes flap 134 to pivot downward toward the floor as the flap slides along the top of actuator 147 from the flap's distal end toward the end closest to core 135.

FIG. 31 is a perspective view of another adjustable actuator 149 which may be used in place of actuator 147. Actuator 149 is square in shape and includes bottom section 150 and top section 151. Bottom section 150 is affixed to the floor, while the vertical position of portion 151 may be adjusted relative to that of section 150 by way of screws 152. By turning screws 152, a user may cause section 151 to move down or up depending on the screw turn direction so that the extent to which security flap 134 pivots in both directions is adjustable. In a manner similar to actuator 149, top portion 153 of actuator 147 is vertically adjustable with respect to bottom portion 154 through turning of screw 148 or alternatively by rotating member 153 about a fixed screw 148. Optionally, element 151 may be adjustably attached to actuator 137 (see FIG. 28) so that screws 152 fit in apertures 139.

FIGS. 32–33 illustrate an embodiment of this invention including security flap locking member 160 which may be used with any of the above-discussed security seal embodiments of this invention. Flap locking member 160 is affixed to interior frame face 113 by way of screws or fasteners 161. Locking member 160 extends beyond face 113 so that it is located directly above flap 134 when the flap is in the secured or closed door position as shown in FIG. 32. In such a manner, member 160 prevents intruders from unlawfully entering the secured location by keeping flap 134 maintained in its down or door-closed position when door 6 is closed and preventing it from being pivoted upward.

FIG. 33 is a top view of the FIG. 32 embodiment, illustrating flap locking member 160 affixed to interior face 113 adjacent housing 132 and flap 134, when door 6 is in the closed position. FIG. 34 is an enlarged perspective view illustrating the FIGS. 32–34 embodiment with locking member 160 keeping flap 134 from being raised when door 6 is in the closed position.

Optionally, the bottom surface of 160 may be angled instead of parallel to the floor to enable vertical and horizontal pinning point adjustment.

FIG. 35 is a perspective view illustrating that core 135 of the gravity-actuated security seal may be pivotally attached within elongated housing 132 to make up the hinge by way of hex screw fasteners 136 on either end of the core.

FIG. 36 is a side cross-sectional view of either a gravity-actuated or spring bias security seal system affixed adjacent the bottom of door 6. As shown in this embodiment, security flap 64, 134 includes distal end portion 163 having an insert 164 located therein for the purpose of creating an improved seal beneath the outside 165 of door 6. A plurality of different inserts 166–169 are illustrated, each of which may be slid into elongated keyway 170 formed in the distal end of the security flap. Both keyway 170 and insert 164 are elongated so that they extend along the entire length of flap 64, 134 between the door frame along the bottom of the door. Turning to the possible inserts, 164, insert 166 includes base member 171 on which a plurality of flexible bristles 172 are mounted. Bristles 172 extend directly upward from base 171 so that they are substantially perpendicular with respect thereto. Insert 167 is an insert which includes a plurality of bristles 173 which are angled with respect to base 171, the angle being between 0° and 90°. Insert 168 includes base 171 on which are mounted a plurality of bristles 174 which extend in different directions relative to the base. Some bristles 174 extend perpendicular from base 171, while others of insert 168 are angled relative to the perpendicular direction. Finally, insert 169 includes elongated oval projection 175 extending from base 171 for the purpose of enhancing the seal between the floor and the bottom of door 6 on its exterior 165 side.

Optionally, any of the FIG. 36 inserts may instead be attached to the side edge 305 of the flap 64, 134 so as to further seal between the flap and door frame. In such embodiments, the bristles would extend toward and contact the door frame. Also, the attachments or inserts could be pivotally attached to the flap by way of a male or female groove defined in the flap edge or end.

FIG. 37 is a side cross-sectional view of either a gravity-actuated or spring-biased security seal system, with the hinge or pivot system 70, 180 being different than in the previously illustrated embodiments. In the previous embodiments, housing 132, which was integrally formed with portion 130, surrounded core 135 which was integrally formed with the security flap, with the core being pivotally mounted within the housing to form the hinge. For example, as shown in FIG. 36, housing 132 has opening 181 defined therein so that the housing is not a complete circle. Opening 181 allows the security flap to extend from the core mounted within the housing.

In contrast, FIG. 37 illustrates an embodiment wherein core 184 is integrally formed with door engaging portion 130, while the exterior housing 185 encompassing the core is integrally formed with security flap 64, 134. As housing 185 is rotatably or pivotally attached around core 184, this permits the security flap 64, 134 to pivot or hinge downward to the secured position when door 6 is closed.

Optionally, biased finger 315 may be affixed to the distal end of the flap so as to seal between the flap and the door bottom finger 315 is biased upward toward the bottom of door 6.

FIGS. 38–41 illustrate alternative embodiments for locking the security flap in the down or secured position when the door is closed. As shown in FIG. 38, recess or cavity 186 is formed in stop 10 on the interior side closest actuator 90. The purpose of cavity or recess 186 is to receive elongated projection 187 which extends outwardly from the end of security flap 64. Projection 187 extends into cavity or recess 186 only when door 6 is in the closed position thereby enabling the recess 186 to prevent flap 64 from being raised when the door is closed. FIG. 39 is a top view of the FIG. 38 security flap 64 illustrating projection 187 extending from an end thereof to be placed adjacent the door frame.

FIGS. 40–41 illustrate an embodiment similar to that of FIGS. 38–39 except that the recess 190 in FIGS. 40–41 is not completely enclosed as in FIGS. 38–39. Instead, recess 190 of FIGS. 40–41 is defined under stop 10 and is open at both the interior side of stop 10 and the soffit side 191 of the stop. Recess 190 functions to receive security flap 64 when door 6 is in the closed position. Unlike the FIGS. 38–39 embodiment, security flap 64 of the FIGS. 40–41 embodiment extends far enough so that its distal end 193 extends into recess 190 when door 6 is closed (i.e. no projection is needed). The FIGS. 40–41 embodiment may be used in conjunction with the spring-loaded security flap as shown or alternatively in conjunction with a gravity-actuated security seal system.

An alternative to the FIGS. 40–41 embodiment would be to affix an elongated member having a lip to the floor across the entire doorway in order to accept end 193 of the flap therein so as to retain the flap in the secure position while the door is closed.

FIGS. 42–43 illustrate additional embodiments of this invention wherein for a spring-biased security seal system, the actuating cam extends from interior stop 10 so that it projects itself substantially parallel to the surface of rabbett 12. As shown in FIG. 42, cam 200 is made up of a rigid plate member affixed to soffit 122 with angled cam portion 201 extending beyond the soffit so as to engage the distal end of security flap 64 when door 6 is being closed. When the distal end of flap 64 meets the upper portion 202 of cam projection 201, the distal end of the flap begins sliding down toward bottom portion 203 of the cam projection thereby causing the security flap to pivot downward into the secured or door closed position. Cam projection 201 also functions to maintain flap 64 in the downward pivoted direction while door 6 is closed.

In the FIG. 43 embodiment, cam 90 is affixed to and protrudes from stop 10 on the interior side of the doorway. Cam 90 is affixed to stop 10 and soffit 122 by way of plate or bracket 205 which includes two angled portions at right angles to one another. Portion 206 of bracket 205 include a pin or the like disposed thereon so that the vertical position of cam 90 is adjustable up and down pin 207.

FIG. 44 is a perspective view of another embodiment of this invention including a security flap locking member affixed to the door frame for the purpose of maintaining the security flap in the secured or downward pivoted position when door 6 is closed. As illustrated, planar projection member 210 is affixed to and extends axially outward from core 135 and hex screw 136. When door 6 is in the closed position as shown in FIG. 44, locking member 212 affixed to the door frame by way of screws 213 maintains projection 210 in a particular orientation thereby preventing security flap 134 from being pivoted upward while the door is closed. For this purpose, blocking member 212 includes a pair of spaced planar members 214 between which projection 210 is maintained when the door is closed. Locking member 212 is preferably affixed to the hinge jamb of the door frame.

When door 6 in the FIG. 44 embodiment is opened, projection or wedge 210 pivots about the core 135 axis in direction 215 as illustrated in FIG. 45 so that the projection slides out of locking member 212 as the door opens. When door 6 is closed, projection 210 pivots in direction 216 and slides downward into the space defined between members 214. Accordingly, projection 210 is cause to pivot about the core axis thereby slipping out of locking member 212 when 1) door 6 is opened and 2) security flap 134 pivots upward. Projection 210 cannot be caused to pivot in direction 215 and slip out of the locking member when the door is closed.

FIGS. 46–47 illustrate alternative embodiments for security flaps 64, 134 to be used in either the spring-biased or gravity-actuated security seal systems discussed above. As illustrated, each security flap in FIGS. 46–47 includes an angled distal end 65 as well as at least one aperture defined in the main elongated body of the security flap. In the FIG. 46 embodiment, elongated aperture 220 is provided in the main body of the security flap so that the flap may function, for example, as a mail slot through which mail may be inserted into a dwelling. Alternatively, instead of aperture 220 in the flap, a cut-away portion of similar size could be formed in the distal end 65 of the flap for the same purpose. In the FIG. 47 embodiment, a plurality of circular apertures 222 are provided in the main body of the security flap for the purpose of permitting ventilation and/or air circulation to and from the dwelling under door 6. The provision of the ventilation allowed by the FIGS. 46–47 embodiments permits the security flaps to close more easily.

FIG. 50 is a perspective view illustrating a particular spring-biased security seal system according to an embodiment of this invention. As illustrated, the coil spring 230 is provided inside of elongated housing 132 within hinge 70 of the security seal system. Spring 230 functions to biased security flap upward into the non-secured position (i.e. substantially parallel to the floor) when the security flap is not in contact with cam 90 or the like. Tension on spring 230 in the FIG. 50 embodiment is provided by securing end 233 of spring 230 within receiving slot 234 of elongated member 235 which is affixed within housing 132. This is generally illustrated at 236. While end 233 of the spring is affixed within slot 234 in a non-rotatable manner, end 237 of spring 230 is secured within slot 238 of elongated member 239. Spring 230 is tensioned by rotating elongated member 239 with the spring secured in slot 238 thereof and, while tension is applied, affixing member 239 relative to housing 132 by placing pin 240 through an aperture in the housing into member 239. As illustrated, a user may rotate member 239 and spring end 237 by using screw driver 241 to turn screw 242 which is affixed to member 239. The direction that 241 is turned determines whether the spring is tensioned up or down. In order to permit member 239 to be affixed in different rotated positions within housing 132, a plurality of apertures 243 are provided in the exterior of housing 132 with corresponding apertures being provided in member 239 so that a pin 240 inserted into an aperture 243 and then into a corresponding aperture in member 239 secures and affixes the position of member 239 relative to housing 132 thereby maintaining tension on spring 230. This allows spring 230 to bias security flap 64 upward into the non-secured position substantially parallel to the bottom of door 6.

FIG. 51 illustrates a spring-biased security seal system according to an embodiment of this invention similar to that discussed above with respect to the FIG. 50 embodiment. The difference between the FIG. 50 embodiment and the FIG. 51 embodiment, is that the spring 250 in the FIG. 51 embodiment differs in design from spring 230 in the FIG. 50 embodiment. As illustrated in FIG. 51, spring 250 has rectangular coil members while spring 230 has circular coil members. Otherwise, the two embodiments function in a similar manner.

It is also to be pointed out that the spring embodiments of FIGS. 50–51 may be used in conjunction with gravity actuated security flaps so as to tension the flap downward thereby overcoming potential resistance.

As illustrated in FIGS. 52–53, the edge of security flaps 64, 134 closest to the hinge door frame is angled downward at 291 where the flap contacts actuator or cam 90. When door 6 closes, angle surface or edge 291 of the security flap comes into contact with cam 90 as discussed above thereby causing the flap to pivot downward into the secured position. The angling of the edge of the flap as shown in FIGS. 52–53 permits the flap to slide more easily at 291 along the actuating surface of cam 90.

Once given the above disclosure, many other features, modifications, and improvements will become apparent to the skilled artisan. Such other features, modifications, and improvements are therefore considered to be a part of this invention, the scope of which is to be determined by the following claims:

I claim:

1. A security seal system attached adjacent a bottom of a door within a door frame, the door having exterior and interior sides, the security seal system comprising:

a door engaging member affixed to the door;

a security flap pivotally connected to said door engaging member; and wherein said security flap includes at least one linear elongated aperture defined therein, said at least one aperture extending all the way through the security flap, and no fasteners or screws being provided in said at least one aperture so that air is permitted to freely flow through said at least one aperture.

2. The system of claim 1, wherein said security flap includes a plurality of apertures defined therein.

3. A security seal system attached adjacent a bottom of a door within a door frame, the door having exterior and interior sides, the security seal system comprising:

a door engaging member affixed to the door;

a security flap pivotally connected to said door engaging member;

wherein said security flap includes at least one aperture defined therein; and wherein said at least one aperture comprises a mail slot through which mail may be inserted.

* * * * *